US010686262B2

(12) United States Patent
Wu et al.

(10) Patent No.: US 10,686,262 B2
(45) Date of Patent: Jun. 16, 2020

(54) CONDUCTIVE COMPONENT STRUCTURE OF ELECTRICAL WIRE CONNECTION DEVICE

(71) Applicants: SWITCHLAB INC., New Taipei (TW); SWITCHLAB (SHANGHAI) CO., LTD., Shanghai (CN); GAOCHENG ELECTRONICS CO., LTD., Shenzhen (CN)

(72) Inventors: Chih-Yuan Wu, New Taipei (TW); Wei-Chi Chen, New Taipei (TW); Ming-Shan Tai, New Taipei (TW)

(73) Assignees: SWITCHLAB INC., New Taipei (TW); SWITCHLAB (SHANGHAI) CO., LTD., Shanghai (CN); GAOCHENG ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 16/351,958

(22) Filed: Mar. 13, 2019

(65) Prior Publication Data

US 2019/0288408 A1 Sep. 19, 2019

(30) Foreign Application Priority Data

Mar. 16, 2018 (TW) ..... 107109102 A

(51) Int. Cl.
*H01R 4/48* (2006.01)
*H01R 9/24* (2006.01)

(52) U.S. Cl.
CPC ..... *H01R 4/4818* (2013.01); *H01R 4/4827* (2013.01); *H01R 9/2416* (2013.01)

(58) Field of Classification Search
CPC ..... H01R 4/48; H01R 4/4809; H01R 4/4818; H01R 4/4827; H01R 4/4836; H01R 4/4845; H01R 4/4881; H01R 4/489
USPC ..... 439/833, 839
See application file for complete search history.

(56) References Cited

U.S. PATENT DOCUMENTS 1,983,281 A * 12/1934 Fries ..... H01H 85/202 439/833
8,062,079 B2 * 11/2011 Hoppmann ..... H01R 4/4836 439/834
8,251,738 B2 * 8/2012 Heckert ..... H01R 4/4836 439/441

(Continued)

*Primary Examiner* — Ross N Gushi
(74) *Attorney, Agent, or Firm* — Rosenberg, Klein & Lee

(57) ABSTRACT

A conductive component structure of electrical wire connection device is more securely assembled with the conductive wire to enhance the electro-conduction performance. The conductive component includes a main body in the form of a plate body, a restriction body connected on the main body and an aid unit (or elastic unit) assembled with the restriction body. The restriction body has a base section, a first arm and a second arm connected with the base section and free sections connected with the first and second arms. The aid unit (or elastic unit) provides greater elastic holding action force for the restriction body. When the conductive wire is plugged into the case into contact with the conductive component, the rear end of the conductive wire is at least securely pressed between the first and second arms of the restriction body without deflecting or swinging due to external force.

38 Claims, 15 Drawing Sheets

(56) References Cited

U.S. PATENT DOCUMENTS

| | | | | |
|---|---|---|---|---|
| 8,550,853 | B2 * | 10/2013 | Fukushi | H01R 4/4836 439/626 |
| 9,184,540 | B2 * | 11/2015 | Wilinski | H01R 4/4836 |
| 9,225,081 | B2 * | 12/2015 | Schrader | H01R 4/48 |
| 9,246,243 | B2 * | 1/2016 | Schuetz | H01R 4/4818 |
| 9,413,085 | B2 * | 8/2016 | Hoppmann | H01R 4/4854 |
| 9,431,724 | B2 * | 8/2016 | France | H01R 4/4818 |
| 9,437,940 | B1 * | 9/2016 | Rao | H01R 4/4836 |
| 9,466,894 | B2 * | 10/2016 | Wu | H01R 4/4845 |
| 9,502,795 | B1 * | 11/2016 | Wu | H01R 4/4827 |
| 9,525,216 | B2 * | 12/2016 | Wu | H01R 4/4809 |
| 9,624,951 | B2 * | 4/2017 | Wu | F16B 2/22 |
| 9,819,121 | B2 * | 11/2017 | Masaki | H01R 4/4827 |
| 9,865,940 | B2 * | 1/2018 | Sichmann | H01R 4/4836 |
| 10,003,142 | B1 * | 6/2018 | Lin | H01R 4/4836 |
| 10,014,596 | B2 * | 7/2018 | Hartmann | H01R 4/5066 |
| 10,020,136 | B2 * | 7/2018 | Wu | H01R 4/4827 |
| 10,038,255 | B2 * | 7/2018 | Wu | H01R 4/4818 |
| 10,103,482 | B2 * | 10/2018 | Stuckmann | H01R 13/2428 |
| 10,109,933 | B2 * | 10/2018 | Stadler | H01R 4/4836 |
| 10,230,179 | B2 * | 3/2019 | Wilinski | H01R 4/4836 |
| 10,267,981 | B1 * | 4/2019 | Wu | H01R 4/26 |
| 10,297,933 | B2 * | 5/2019 | Wu | H01R 4/4827 |
| 10,367,271 | B1 * | 7/2019 | Wu | H01R 9/24 |
| 10,367,276 | B2 * | 7/2019 | Wu | H01R 9/26 |
| 10,411,371 | B2 * | 9/2019 | Pizzi | H01R 4/4827 |
| 10,418,727 | B1 * | 9/2019 | Wu | H01R 4/4836 |
| 2007/0218730 | A1 * | 9/2007 | Wu | H01R 4/4827 439/164 |
| 2009/0130893 | A1 * | 5/2009 | Revollon | H01R 4/4827 439/460 |
| 2018/0269602 | A1 * | 9/2018 | Otto | H01R 4/50 |
| 2018/0277965 | A1 * | 9/2018 | Dhanjal | H01R 9/223 |
| 2018/0301823 | A1 * | 10/2018 | Riku | H01R 4/4845 |
| 2018/0331449 | A1 * | 11/2018 | Juelich | H01R 4/4836 |
| 2018/0342815 | A1 * | 11/2018 | Wu | H01R 12/515 |
| 2018/0342816 | A1 * | 11/2018 | Wu | H01R 4/4845 |
| 2018/0342817 | A1 * | 11/2018 | Wu | H01R 4/4818 |
| 2019/0013598 | A1 * | 1/2019 | Wu | H01R 4/26 |
| 2019/0288408 | A1 * | 9/2019 | Wu | H01R 9/2416 |
| 2019/0288413 | A1 * | 9/2019 | Wu | H01R 4/4827 |

* cited by examiner

CONDUCTIVE COMPONENT STRUCTURE OF ELECTRICAL WIRE CONNECTION DEVICE

BACKGROUND OF THE INVENTION

1. Field of the Invention

The present invention relates generally to a conductive component structure of electrical wire connection device, and more particularly to a conductive component having a restriction body and an aid unit or an elastic unit for guiding the conductive wire and enhancing the securing effect of the restriction body for the conductive wire.

2. Description of the Related Art

A conventional terminal device or switch wire connection device has an insulation case (generally made of plastic material), a metal component (or so-called electrical conductive component) and a leaf spring conductor (or so-called metal leaf spring). The metal component and the leaf spring conductor are enclosed in the insulation case to press and electrically connect with or release a conductive wire plugged in the terminal device. For example, EP 2325947 A1 discloses a typical example.

Multiple conventional electrical connection terminals can be latched with a grounding rail (or conductive rail) in a row to set up a common grounding device of an electrical apparatus or mechanical equipment for conducting out the residual voltage or static of the machine. For example, US 2013/0143433 A1 "connection terminal", US 2014/0127932 A1 "electrical connection terminal", and U.S. Pat. No. 5,362,259 "ground conductor terminal" disclose typical examples.

Such electrical connection terminal or switch wire connection device generally includes an insulation case having a wire plug-in hole for the conductive wire to plug into the interior of the case. The case defines a chamber in which a conductive support (or conductive component) and a metal leaf spring are mounted. The metal leaf spring and the conductive component serve to press the conductive wire plugged into the case and contact or electrically connect with the conductive wire. Unless an operator uses a tool to extend into the case and push/press the metal leaf spring, the conductive wire cannot be released from the electrical connection or contact with the metal leaf spring and the conductive component.

The assembling structure of the conventional electrical connection terminal or switch wire connection device has some shortcomings in structure and operation application. For example, in practical wire layout operation, after a conductive wire is plugged into the case to connect with the conductive component, an operator will bend the conductive wire outside the case to perform wire trimming operation in accordance with the site space condition or wire layout path. The wire trimming operation is performed because when the metal leaf spring presses the conductive wire, a leverage effect is often produced to cause the rear end of the conductive wire to warp up (or leave the conductive component). As a result, the contact area between the conductive wire and the conductive support (or conductive component) is reduced to increase the impedance and raise the temperature of the conductive support. In case the temperature of the conductive support exceeds the heat tolerance of the plastic insulation case, the case will be damaged to affect the security.

In order to improve the shortcomings of insufficient pressing force and electro-conductive insecurity or efficiency, a conventional electrical connection terminal has been disclosed, which additionally includes a leaf spring arranged behind the metal leaf spring to help in pressing the conductive wire. For example, EP 3226351 A1 and EP 3226352 A1 disclose typical examples.

However, as well known by those who are skilled in this field, such electrical connection terminal is simply applicable to specific conductive wire or relatively small-diameter conductive wire to provide sufficient pressing force. When such conventional electrical connection terminal or switch wire connection device is connected with a large-diameter conductive wire, it often takes place that the pressing force applied by the metal leaf spring and the conductive component to the conductive wire is insufficient, the conductive wire can be hardly securely pressed, the rear end of the conductive wire is warped up and the conductive wire is apt to rotate, deflect or swing due to incautious touch of an operator to lead to poor contact and insecurity. This is not what we expect.

Another conventional electrical connection terminal has been disclosed, which includes a leaf spring and a steel leaf spring overlapped with the leaf spring to increase the pressing force for the conductive wire.

To speak representatively, the above reveals some shortcomings existing in the conventional wire connection terminal or switch wire connection device in structure assembly design and application. In case the structure assembly of the conductive component and the metal leaf spring or leaf spring conductor is redesigned to be different from the conventional wire connection terminal, the use form of the wire connection terminal can be changed to practically widen the application range thereof.

It is found that the structural form of an optimal conductive component must overcome or improve the aforesaid shortcomings of the conventional wire connection terminal and include several design considerations as follows:

1. In condition that the thickness of the conductive component and/or the metal leaf spring is not increased, the cooperative structures of the conductive component and/or the metal leaf spring must be able to provide sufficient pressing force so that the wire connection terminal or switch wire connection device is applicable to a large-diameter conductive wire. Also, the conductive component and/or the metal leaf spring of the electrical connection terminal must overcome the shortcomings of the conventional electrical connection terminal that the pressing force applied by the metal leaf spring and the conductive component to the conductive wire is insufficient, the conductive wire can be hardly securely pressed and the conductive wire is apt to deflect or swing due to incautious touch of an operator to lead to poor contact and insecurity.
2. As aforesaid, when the metal leaf spring presses the conductive wire, a leverage effect is often produced to cause the rear end of the conductive wire to warp up (or leave the conductive component). As a result, the contact area between the conductive wire and the conductive component is reduced to affect the electro-conduction efficiency. This shortcoming must be improved.
3. Moreover, the electrical connection terminal must provide a conductive component structure, which is able to help the metal leaf spring in pressing the conductive wire and is able to guide the conductive wire and help in fixing the conductive wire so as to minimize the possibility of rotation, deflection or swing of the conductive wire.

SUMMARY OF THE INVENTION

It is therefore a primary object of the present invention to provide a conductive component structure of electrical wire connection device is more securely assembled with the conductive wire to enhance the electro-conduction performance. The conductive component includes a main body in the form of a plate body, a restriction body connected on the main body and an aid unit (or elastic unit) assembled with the restriction body. The restriction body has a base section, a first arm and a second arm connected with the base section and free sections connected with the first and second arms. The aid unit (or elastic unit) provides greater elastic holding action force for the restriction body. When the conductive wire is plugged into the case into contact with the conductive component, the rear end of the conductive wire is at least securely pressed between the first and second arms of the restriction body. The conductive component improves the shortcomings of the conventional structure that the conductive wire is apt to deflect or swing due to external force to lead to unstable contact and insecurity and affect the electro-conduction efficiency.

In the above conductive component structure of electrical wire connection device, the first arm and/or the second arm are bent from the base section to obliquely extend toward each other or in the same direction to define a mouth section. In addition, a bent section is formed between the first arm and the free section thereof and/or the second arm and the free section thereof to form an opening. Also, the free section of the first arm and/or the free section of the second arm are bent to extend toward outer side of the restriction body (or away from each other), whereby the restriction body can be elastically expanded to hold different diameters of conductive wires.

In the above conductive component structure of electrical wire connection device, the aid unit is a U-shaped structure having a base, a first waist section and a second waist section connected with the base and finger sections connected with the first waist section and/or the second waist section, whereby the aid unit can provide an elastic (holding) effect. The finger sections contact (or latch with) the bent section of the first arm or the bent section of the second arm of the restriction body to enhance the pressing action force applied by the first and second arms of the restriction body to the conductive wire. The finger sections also serve to control the expansion range of the first and second arms in response to the plug-in of the conductive wire so as to prevent the restriction body from permanently deforming.

The present invention can be best understood through the following description and accompanying drawings, wherein:

DETAILED DESCRIPTION OF THE PREFERRED EMBODIMENTS

Figure 1:
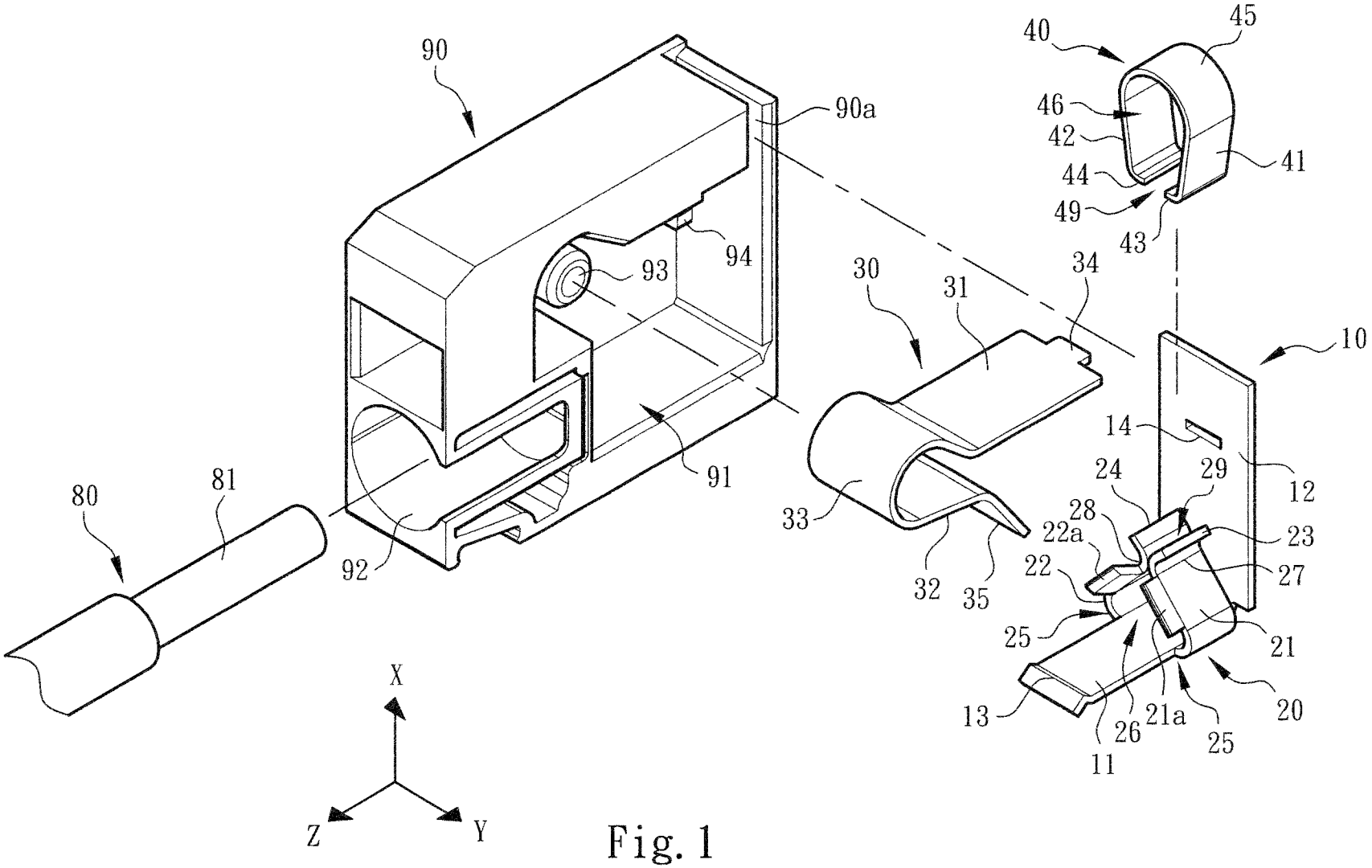
FIG. 1 is a perspective exploded view of the present invention, showing the structures of the case and the main body, the metal leaf spring, the restriction body integrally formed on the main body and the aid unit of the conductive component.
Figure 3:
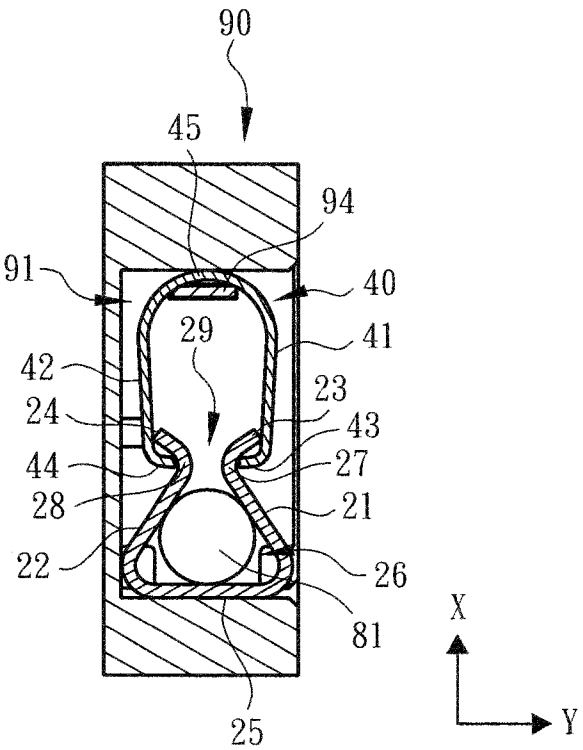
FIG. 3 is a sectional view according to FIG. 2, showing the structural relationship between the main body, the restriction body, the aid unit and the conductive wire.
Figure 2:
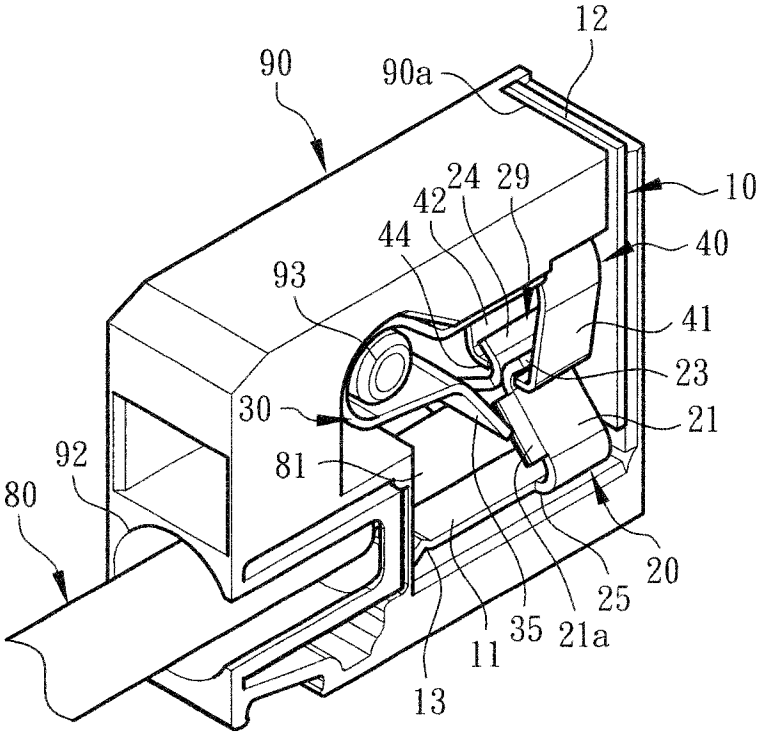
FIG. 2 is a perspective assembled view according to FIG. 1.

Please refer to FIGS. 1, 2 and 3. The conductive component structure of electrical wire connection device of the present invention includes an assembly of a main body 10, a restriction body 20 and an aid unit 40. The conductive component (or the main body 10 and the restriction body 20) is defined with an X-direction reference axis, a Y-direction reference axis and a Z-direction reference axis normal to each other. The conductive wire 80 is plugged into the conductive component in a direction identical to or parallel to the Z-direction reference axis. Moreover, the conductive component in cooperation with a metal leaf spring 30 is mounted in a case 90 made of insulation material to form the wire connection terminal, the switch wire connection device or the like device.

Basically, the case 90 defines a chamber 91, in which the main body 10, the restriction body 20, the aid unit 40 and the metal leaf spring 30 of the conductive component are mounted. The case 90 has a wire plug-in hole 92 in communication with the chamber 91. The conductive wire 80 can be plugged through the wire plug-in hole 92 into the chamber 91 of the case 90 and the conductive component to electrically connect therewith.

The upper section, lower section, outer side and inner side mentioned hereinafter are recited with the direction of the drawings as the reference direction.

As shown in the drawings, the main body 10 is selectively made of an electro-conductive material (such as copper, brass or the like material) in the form of a plate body. The main body 10 has a first section 11 in parallel to the Z-direction reference axis and a second section 12 (perpendicularly) connected with the first section 11. The second section 12 is assembled and located in a locating slot 90*a* of the case 90. One end of the first section 11 is formed with a raised ridge section 13 as a load section for helping in pressing the conductive wire 80. The locating slot 90*a* of the case 90 is formed in a direction or a position along the X-direction reference axis.

In a preferred embodiment, the restriction body 20 is integrally formed (or assembled) on the main body 10. The restriction body 20 is selectively made of an electro-conductive (metal) material and disposed on the first section 11 of the main body 10. The restriction body 20 has a base section 25 connected with the main body 10 (or the first section 11), a first arm 21 and a second arm 22 connected with the base section 25 and free sections 23, 24 connected with the first and second arms 21, 22, which together provide elastic effect for the restriction body 20.

To speak more specifically, the first and second arms 21, 22 are respectively bent from the base section 25 to gradually obliquely extend toward each other along the X-direction reference axis (or in a direction normal to the plug-in direction of the conductive wire 80). The first and second arms 21, 22 define a mouth section 26 with a triangular configuration. A bent section 27, 28 is formed between each of the first and second arms 21, 22 and the free sections 23, 24, whereby the free section 23 of the first arm 21 and the free section 24 of the second arm 22 are bent to extend away from each other so as to define an opening 29, whereby the restriction body 20 can be elastically expanded to hold different diameters of conductive wires 80. As shown in the drawings, the opening 29 is open to the upper side (or along the X-direction reference axis).

FIGS. 1, 2 and 3 also show that wing sections 21*a*, 22*a* respectively protrude from the first and second arms 21, 22 of the restriction body 20 and diverge to outer side of the restriction body 20 in a direction to the conductive wire 80 plugged into the case 90 or the wire plug-in hole 92 (or along the Z-direction reference axis). The wing sections 21*a*, 22*a* serve to help in guiding the conductive wire 80 to enter the conductive component.

In this embodiment, the metal leaf spring 30 is a substantially V-shaped structure including a first section 31, a second section 32 and a bow section 33 connected between the first and second sections 31, 32. The first section 31 has a head end 34 secured in a locating hole 14 of the case 90 or the main body 10. The bow section 33 is assembled on a stake 93 of the case 90 or the chamber 91, whereby the tail end 35 of the second section 32 can be elastically biased to press the conductive wire 80. As shown in the drawings, the locating hole 14 is disposed on the second section 12 of the main body.

The drawings also show the structures of the restriction body 20 and the aid unit 40 assembled with each other. The aid unit 40 is a U-shaped structure having an (arched) base 45, a first waist section 41 and a second waist section 42 connected with the base 45 and finger sections 43, 44 connected with the first and second waist sections 41, 42, which together define a space 46 with an opening 49, whereby the aid unit 40 can provide an elastic (holding) effect.

To speak more specifically, the first and second waist sections 41, 42 are respectively bent from two ends of the base 45 to extend along the X-direction reference axis (or in a direction normal to the plug-in direction of the conductive wire 80). The first and second waist sections 41, 42 are further bent toward each other along the Y-direction reference axis to form the finger sections 43, 44. The base 45 of the aid unit 40 is assembled on a locating section 94 of the case 90 (or the chamber 91) in the form of a plate-like structure). The finger sections 43, 44 contact or latch with the bent section 27 of the first arm and the bent section 28 of the second arm of the restriction body 20 to increase the elastic pressing action force applied by the first and second arms 21, 22 of the restriction body to the conductive wire 80. The finger sections 43, 44 also serve to control the expansion range of the first and second arms 21, 22 in response to the plug-in of the conductive wire 80 so as to prevent the restriction body 20 from permanently deforming.

Please refer to FIGS. 2 and 3. When the conductive wire 80 is plugged into the wire plug-in hole 92 (along the Z-direction reference axis) to contact the conductive component, the tail end 35 of the second section 32 of the metal leaf spring (in cooperation with the ridge section 13 of the main body 10) presses the conductive wire 80 against the main body 10. The rear end 81 of the conductive wire 80 goes through the wing sections 21*a*, 22*a* into the mouth section 26 of the restriction body 20, whereby the conductive wire 80 is elastically securely held by the first and second arms 21, 22 in cooperation with the aid unit 40. This improves the shortcoming of the conventional electrical connection terminal that due to external force, the conductive wire is apt to deflect or swing to lead to unstable contact and affect the electro-conduction efficiency and security. Moreover, the first and second arms 21, 22 in cooperation with the aid unit 40 press the conductive wire 80 (or the rear end 81 of the conductive wire 80) toward the main body 10 or the center of the restriction body 20 (or the mouth section 26) to increase the electro-conductive contact area and the electro-conduction efficiency.

It should be noted that when a relatively large-diameter conductive wire is plugged into the conductive component and/or the wire trimming operation is performed, the rear end 81 of the conductive wire may be warped up. At this time, the rear end 81 of the conductive wire will be pressed/restricted or detained in the mouth section 26 by the first and second arms 21, 22 (and the aid unit 40) to keep in contact with the conductive component. This obviously improves the shortcoming of the conventional electrical connection terminal that the rear end of the conductive wire is apt to warp up and leave the conductive component so that the contact area between the conductive wire and the conductive component is reduced and the impedance is increased to raise the temperature of the conductive component.

Figure 4:
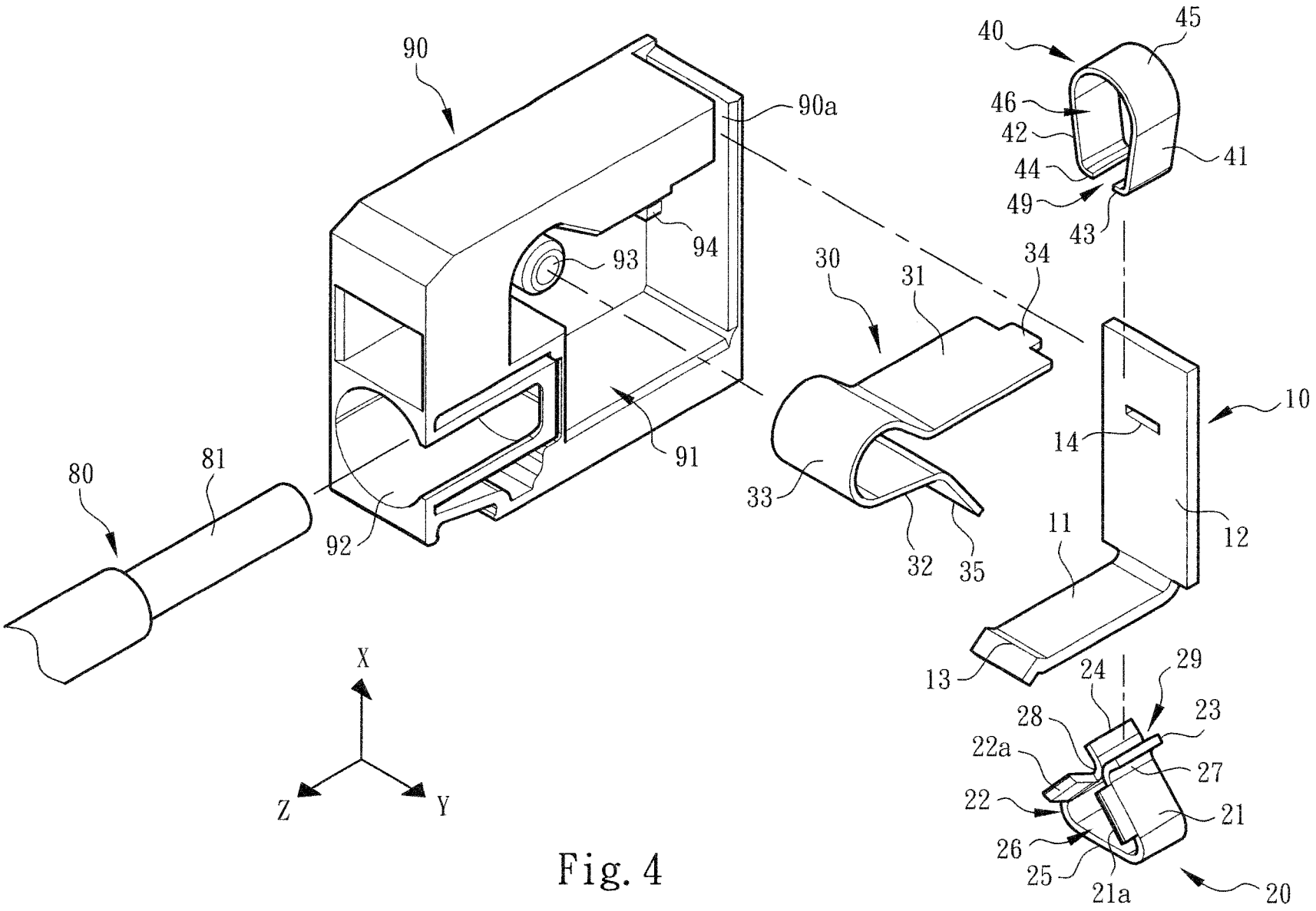
FIG. 4 is a perspective exploded view of a modified embodiment of the present invention, in which the restriction body and the main body are two pieces of components.

FIG. 4 shows a modified embodiment of the present invention, in which the restriction body 20 and the main body 10 are two pieces of components. The first and second arms 21, 22 of the restriction body are respectively bent from two ends of the base section 25 to gradually obliquely extend toward each other along the X-direction reference axis (or in a direction normal to the plug-in direction of the conductive wire 80). The first and second arms 21, 22 define the mouth section 26. A bent section 27, 28 is formed between each of the first and second arms 21, 22 and the free sections 23, 24, whereby the free section 23 of the first arm 21 and the free section 24 of the second arm 22 are bent to extend away from each other so as to define an opening 29.

Figure 5:
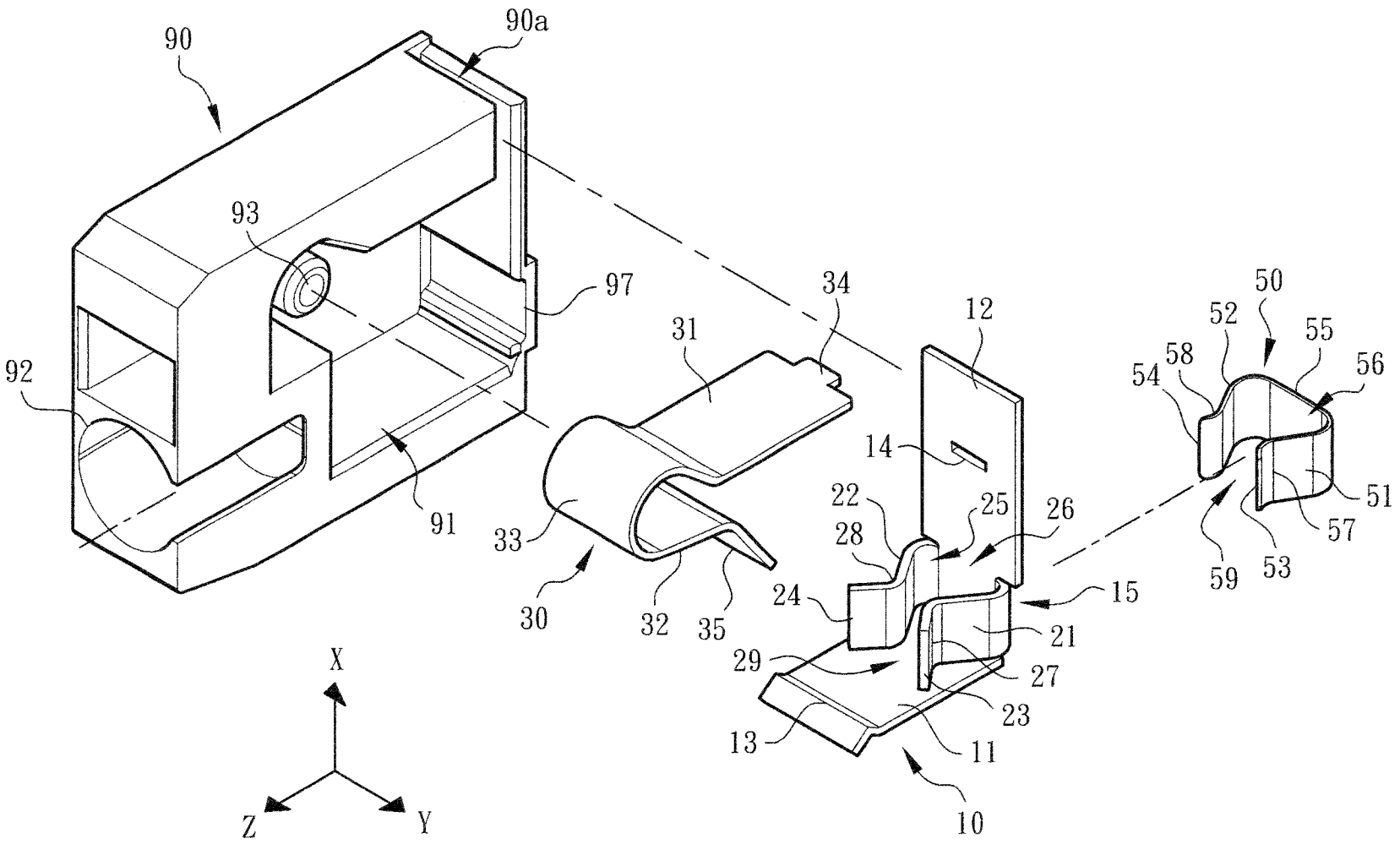
FIG. 5 is a perspective exploded view of a modified embodiment of the present invention, showing the structures of the case and the main body, the metal leaf spring, the restriction body integrally formed on the main body and the elastic unit of the conductive component.
Figure 7:
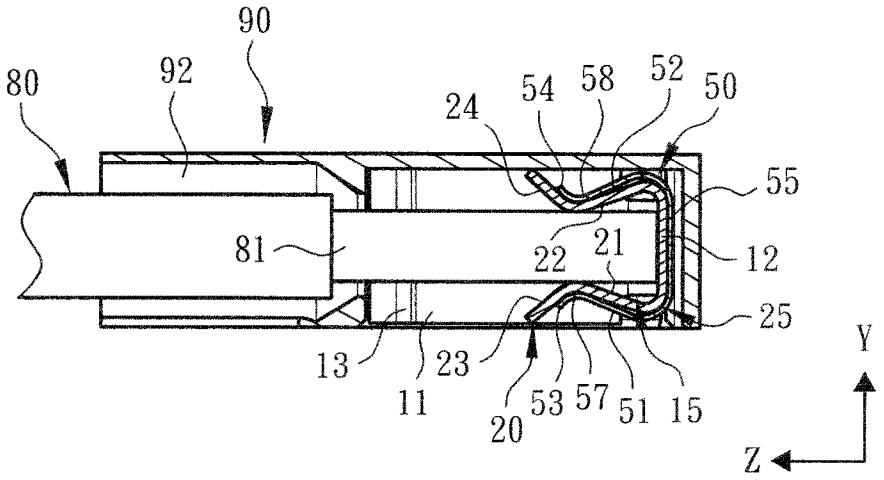
FIG. 7 is a sectional view according to FIG. 6, showing the structural relationship between the main body, the restriction body, the elastic unit and the conductive wire.
Figure 6:
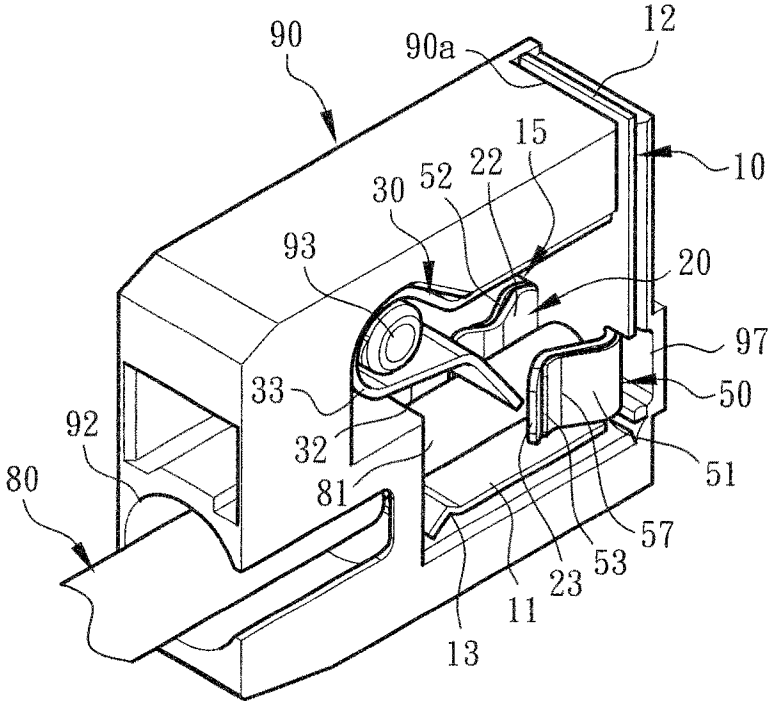
FIG. 6 is a perspective assembled view according to FIG. 5.

Please refer to FIGS. 5,6 and 7. The case 90 is formed with a recessed section 97 in communication with the chamber 91 for locating or receiving an elastic unit 50 and/or the base section 25 of the restriction body 20. The restriction body 20 is integrally formed and connected with the second section 12 of the main body. The base section 25 of the restriction body 20 is connected with the main body 10 (or the second section 12) or the second section 12 is formed with a neck section 15.

As shown in the drawings, the first and second arms 21, 22 of the restriction body are respectively bent from the base section 25 to gradually obliquely extend toward each other along the Z-direction reference axis (or in the plug-in direction of the conductive wire 80). The first and second arms 21, 22 define the mouth section 26.

A bent section 27, 28 is formed between each of the first and second arms 21, 22 and the free sections 23, 24, whereby the free section 23 of the first arm 21 and the free section 24 of the second arm 22 are bent to extend away from each other so as to define an opening 29 along the Z-direction reference axis (or in the plug-in direction of the conductive wire 80).

In this embodiment, the elastic unit 50 serves to help in increasing the elastic holding/securing action force applied by the restriction body 20 to the conductive wire 80. The elastic unit 50 is selectively made of an electro-conductive material identical to the restriction body 20 or a material with rigidity (or elastic action force) greater than that of the restriction body 20, such as steel material or the like material.

As shown in FIGS. 5, 6 and 7, the elastic unit 50 has a base 55 received in the recessed section 97 of the case, a first arm 51 and a second arm 52 (passing through the neck section 15 of the main body and extending along the Z-direction reference axis) connected with the base 55 and free sections 53, 54 connected with the first and second arms 51, 52.

As shown in the drawings, the first and second arms 51, 52 of the elastic unit are respectively bent from two ends of the base 55 to gradually obliquely extend toward each other along the Z-direction reference axis (or in the plug-in direction of the conductive wire 80). The first and second arms 51, 52 define a mouth section 56 with a triangular configuration. A bent section 57, 58 is formed between each of the first and second arms 51, 52 and the free sections 53, 54 of the elastic unit, whereby the free section 53 of the first arm 51 and the free section 54 of the second arm 52 of the elastic unit are bent to extend away from each other so as to define an opening 59 along the Z-direction reference axis (or in the plug-in direction of the conductive wire 80). Accordingly, the elastic unit encloses or overlaps a part of the restriction body 20 or the entire restriction body 20.

Please refer to FIGS. 6 and 7. When the conductive wire 80 is plugged through the wire plug-in hole 92 into the chamber 91 of the case and the conductive component, the rear end 81 of the conductive wire 80 is securely held by the bent section 27 of the first arm and the bent section 28 of the second arm in cooperation with the elastic unit 50. Therefore, even if the rear end 81 of the conductive wire is warped up, the rear end 81 of the conductive wire will still keep in contact with the first section 11 of the main body and the first and second arms 21, 22 of the restriction body.

Figure 8:
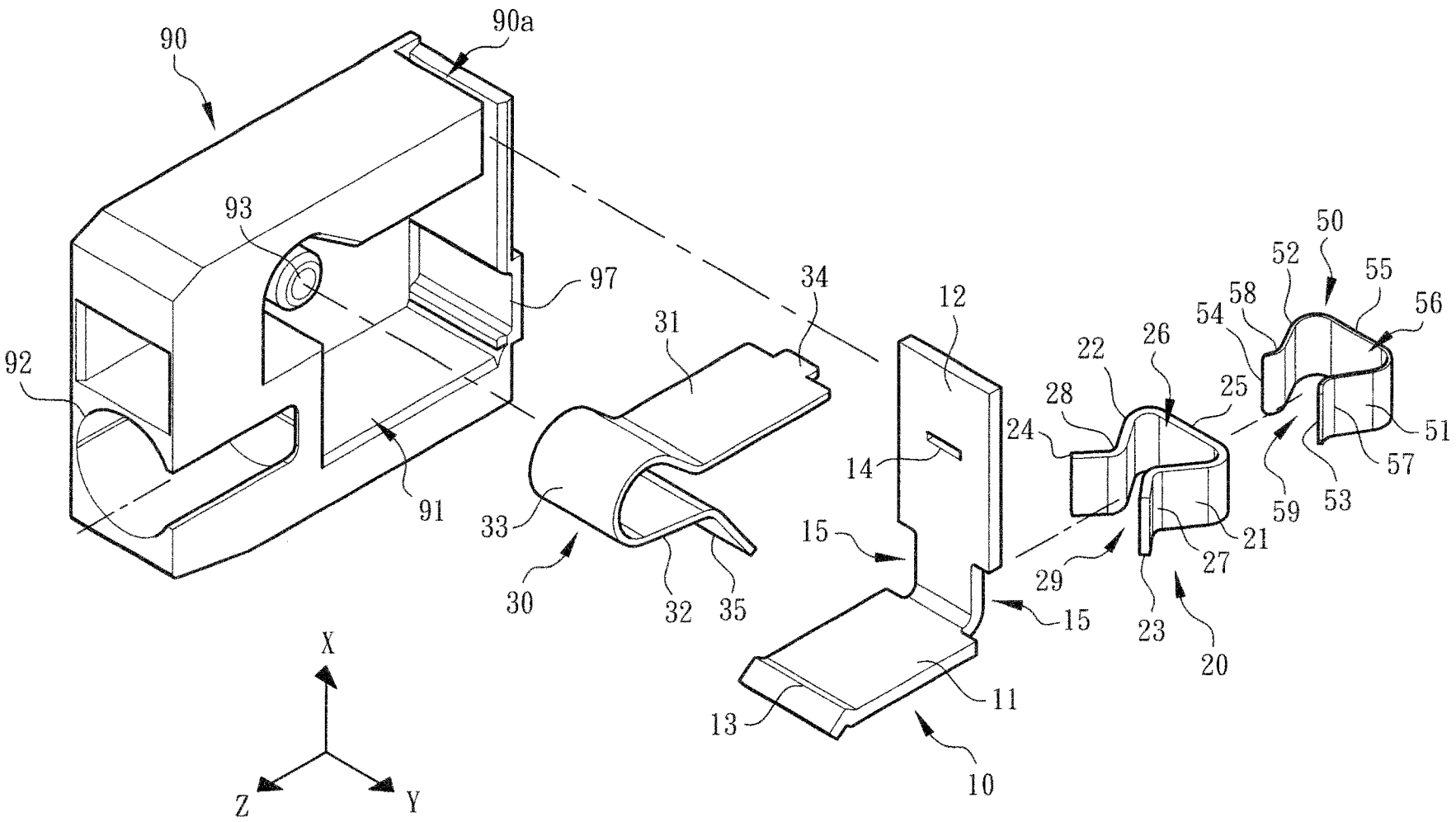
FIG. 8 is a perspective exploded view of a modified embodiment of the present invention, in which the restriction body and the main body are two pieces of components.

FIG. 8 shows a modified embodiment of the present invention, in which the restriction body 20 and the main body 10 are two pieces of components. The base section 25 of the restriction body 20 is assembled with the main body 10 (or the second section 12). The first and second arms 21, 22 of the restriction body 20 are respectively bent from two ends of the base section 25 to pass through the neck section 15 of the main body and gradually obliquely extend toward each other along the Z-direction reference axis (or in the plug-in direction of the conductive wire 80) to define the mouth section 26. A bent section 27, 28 is formed between each of the first and second arms 21, 22 and the free sections 23, 24 of the restriction body, whereby the free section 23 of the first arm 21 and the free section 24 of the second arm 22 are bent to extend away from each other so as to define an opening 29.

Figure 9:
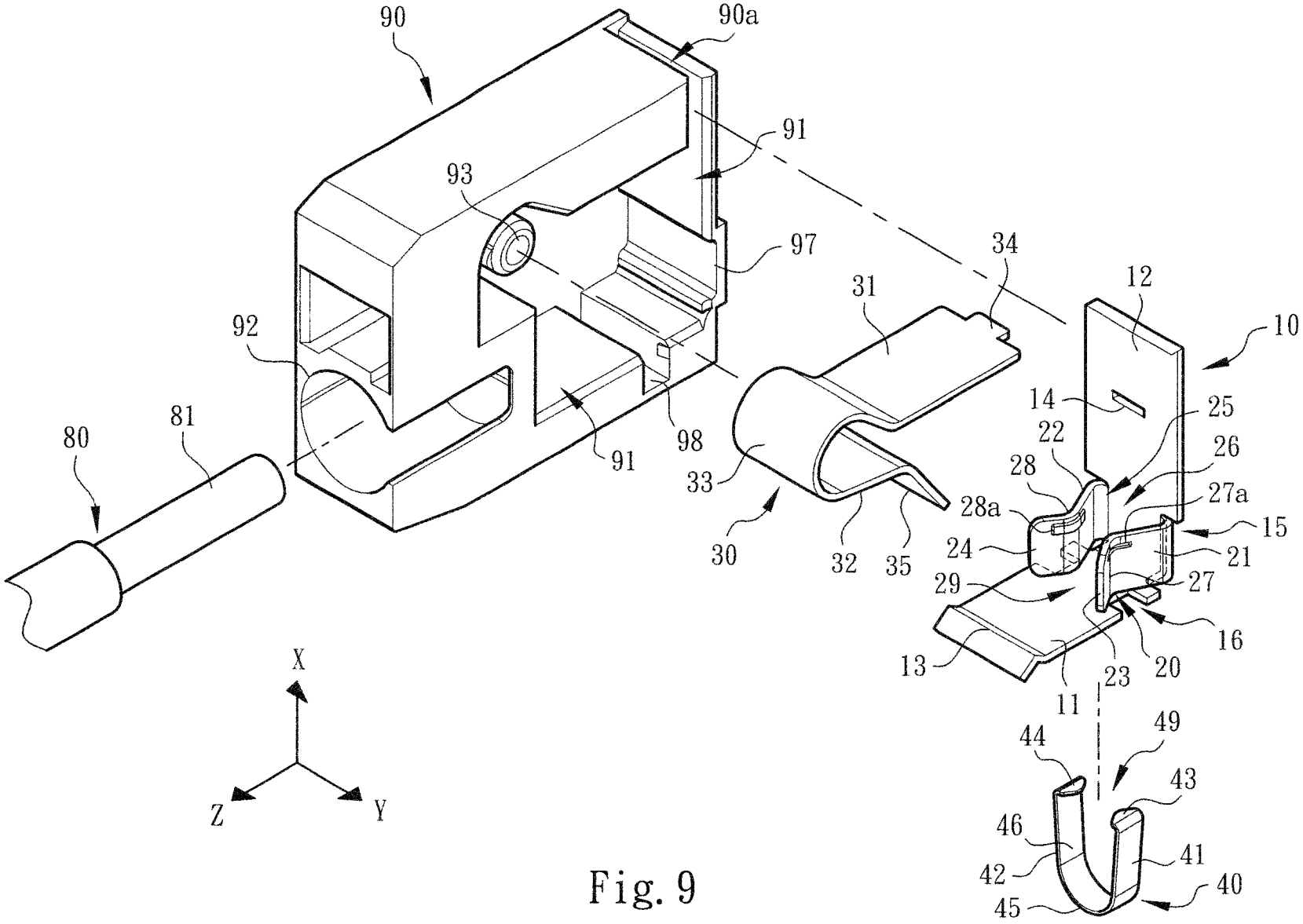
FIG. 9 is a perspective exploded view of a modified embodiment of the present invention, showing the structures of the case and the main body, the metal leaf spring, the restriction body integrally formed on the main body and the aid unit of the conduct ive component.
Figure 11:
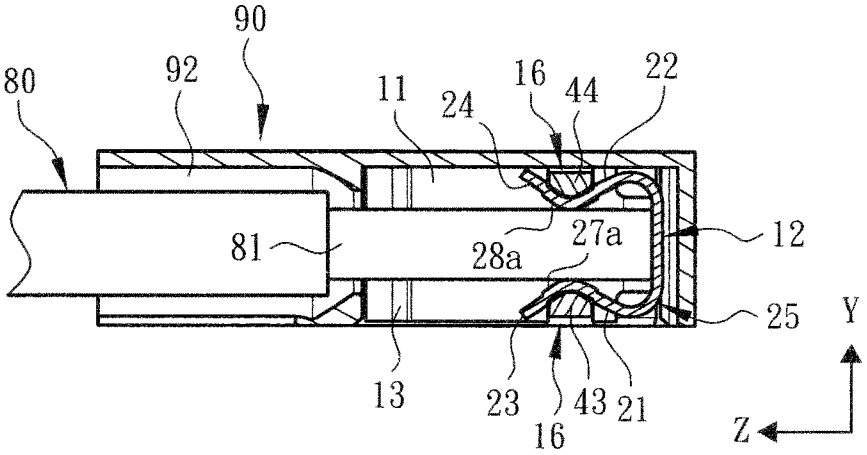
FIG. 11 is a sectional view according to FIG. 10, showing the structural relationship between the main body, the restriction body, the aid unit and the conductive wire.
Figure 10:
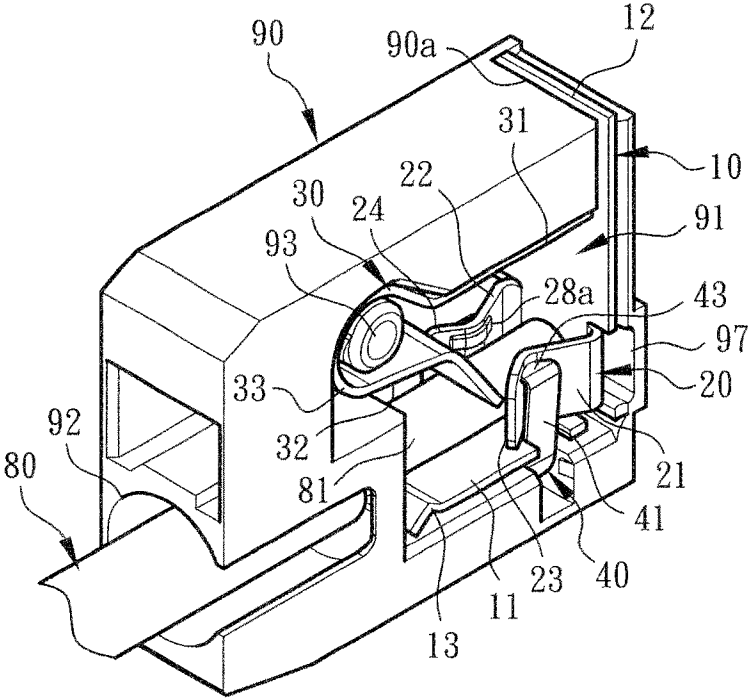
FIG. 10 is a perspective assembled view according to FIG. 9.

Please refer to FIGS. 9, 10 and 11. The lower section of the case 90 is formed with an insertion cavity 98 in communication with the chamber 91 for helping in locating the aid unit 40 (or the base 45 of the aid unit). The lateral sides of the first section 12 of the main body are formed with notches 16 for assembling with the aid unit 40 (or the first and second waist sections 41, 42 of the aid unit). Accordingly, the first and second waist sections 41, 42 of the aid unit can extend along the X-direction reference axis (or toward the upper side of the case 90 in a direction normal to the conductive wire 80), whereby the finger sections 43, 44 can press/connect or latch with the restriction body 20.

As shown in the drawings, the restriction body 20 is formed with insertion sections 27*a*, 28*a*, with which the finger sections 43, 44 of the aid unit 40 are inserted. In a preferred embodiment, the insertion sections 27*a*, 28*a* are groove or dent structures positioned on the bent sections 27, 28 and/or the first and second arms 21, 22 and the free sections 23, 24 of the restriction body 20.

It should be noted that the inner sides of the first and second arms 21, 22 are formed with raised structures corresponding to the insertion sections 27*a*, 28*a*. Therefore, as shown in FIG. 10, the insertion sections 27*a*, 28*a* serve to prevent the rear end 81 of the conductive wire from moving upward or warping up. In addition, the aid unit 40 helps in increasing the elastic pressing action force applied by the restriction body 20 to the conductive wire 80 as shown in FIG. 11.

Figure 12:
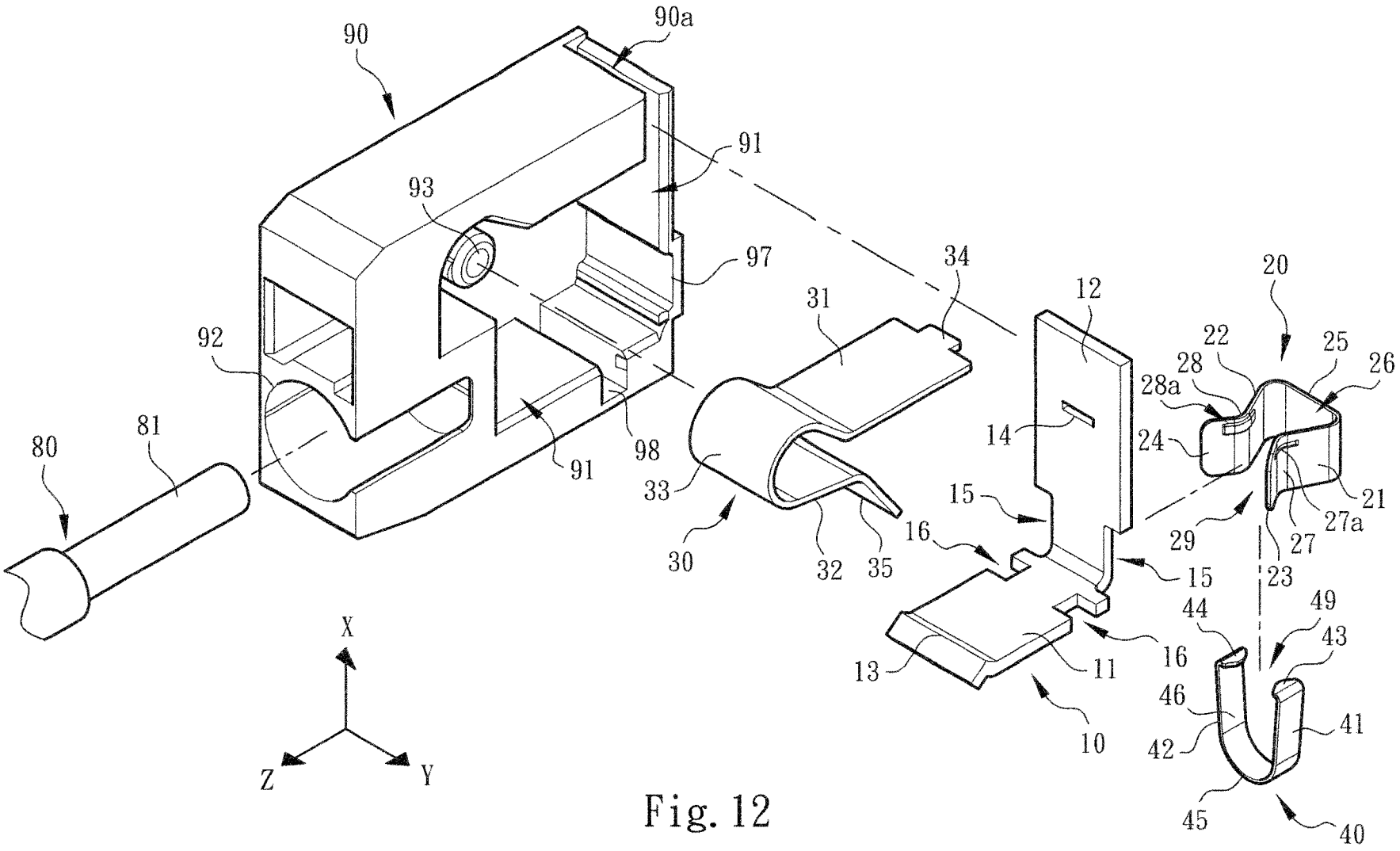
FIG. 12 is a perspective exploded view of a modified embodiment of the present invention, in which the restriction body and the main body are two pieces of components.

FIG. 12 shows a modified embodiment of the present invention, in which the restriction body 20 and the main body 10 are two pieces of components. The base section 25 of the restriction body 20 is assembled with the main body 10 (or the second section 12). The first and second arms 21, 22 are respectively bent from two ends of the base section 25 to pass through the neck section 15 of the main body and gradually obliquely extend toward each other along the Z-direction reference axis (or in the plug-in direction of the conductive wire 80) to define the mouth section 26. A bent section 27, 28 is formed between each of the first and second arms 21, 22 and the free sections 23, 24 of the restriction body, whereby the free section 23 of the first arm 21 and the free section 24 of the second arm 22 are bent to extend away from each other so as to define an opening 29.

Figure 13:
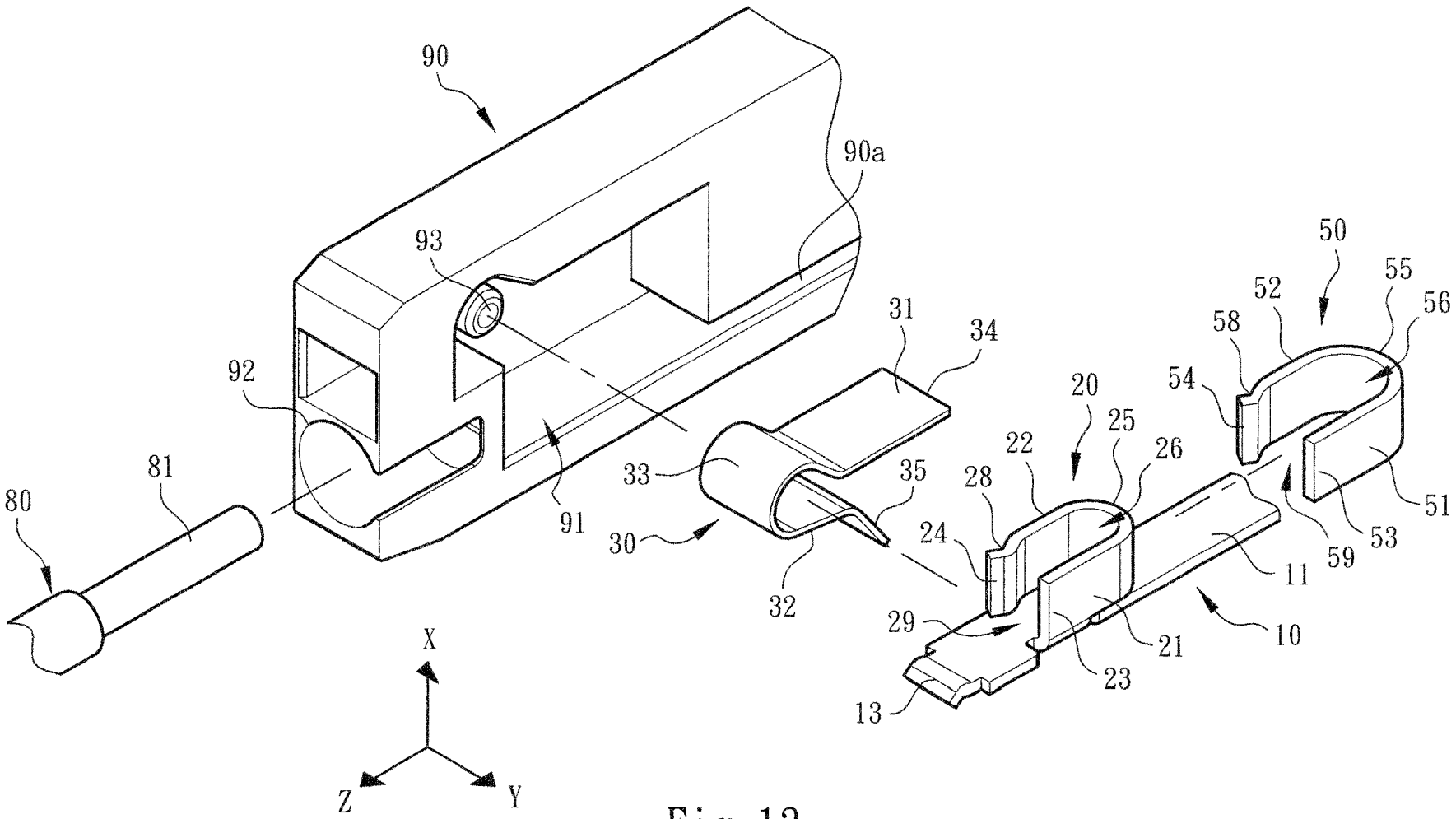
FIG. 13 is a perspective exploded view of a modified embodiment of the present invention, showing the structures of the case and the main body, the metal leaf spring, the restriction body integrally formed on the main body and the elastic unit of the conductive component.
Figure 15:
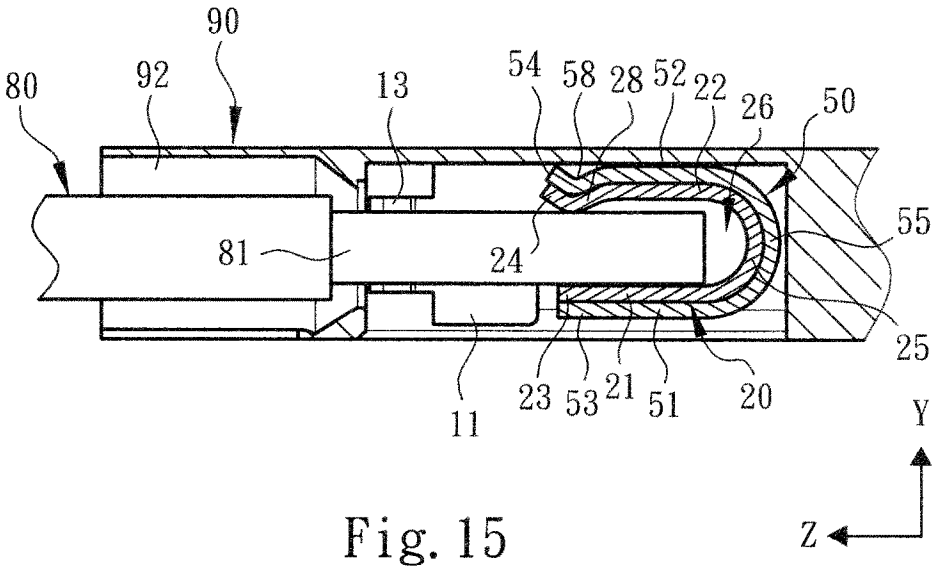
FIG. 15 is a sectional view according to FIG. 14, showing the structural relationship between the main body, the restriction body, the elastic unit and the conductive wire.
Figure 14:
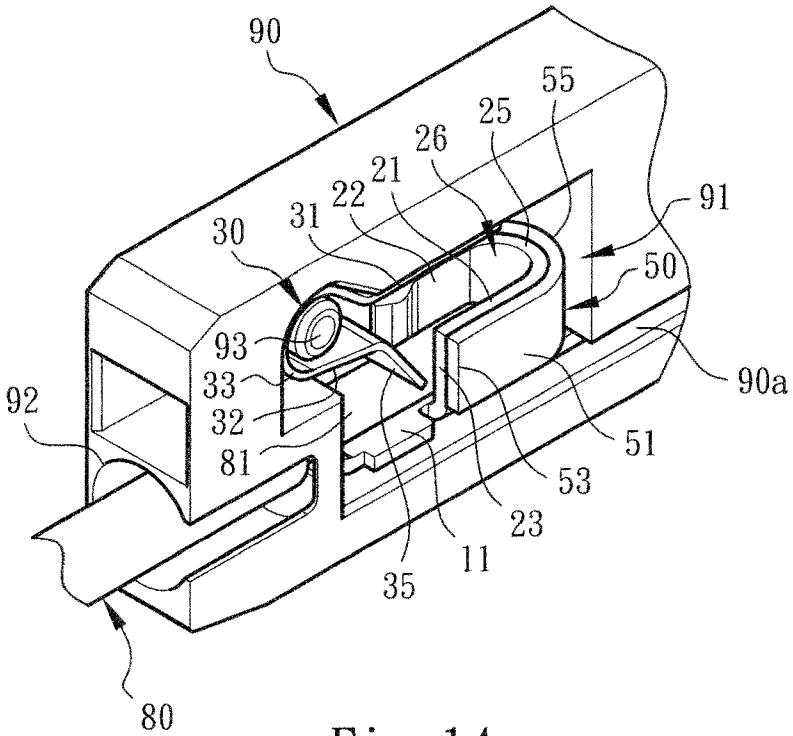
FIG. 14 is a perspective assembled view according to FIG. 13.

Please refer to FIGS. 13, 14 and 15. The other end of the case 90 opposite to the wire plug-in hole 92 is formed with a locating slot 90*a* in communication with the chamber 91. The locating slot 90*a* extends along the Z-direction reference axis (or in the plug-in direction of the conductive wire 80) for assembling with or securing the main body 10 (the first section 11).

As shown in the drawings, at least the first arm 21 (and/or the second arm 22) of the restriction body 20 is integrally connected with the first section 11 of the main body along the Z-direction reference axis (or in the plug-in direction of the conductive wire 80). In addition, the first arm 21 (and/or the second arm 22) of the restriction body 20 is bent along the Y-direction reference axis to form a base section 25 connected with the first and second arms 21, 22 to together define the mouth section 26 with the opening 29. A bent section 28 is formed between the second arm 22 (and/or the first arm 21) and the free section 24 (and/or the free section 23). The free section 24 of the second arm 22 (and/or the free section 23 of the first arm 21) is bent to extend toward the outer side of the restriction body 20, whereby the opening 29 is open along the Z-direction reference axis (or in the plug-in direction of the conductive wire 80).

In this embodiment, the elastic unit 50 assembled with the restriction body 20 is similar to or identical to the restriction body 20. At least the first arm 51 (and/or the second arm 52) of the elastic unit 50 extends along the Z-direction reference axis (or in the plug-in direction of the conductive wire 80). In addition, the first arm 21 (and/or the second arm 22) of the elastic unit 50 is bent along the Y-direction reference axis to form a base section 55 connected with the first and second arms 51, 52 to together define the mouth section 56 with the opening 59.

As shown in the drawings, a bent section 58 is formed between the second arm 52 (and/or the first arm 51) and the free section 54 (and/or the free section 53). The free section 54 of the second arm 52 (and/or the free section 53 of the first arm 51) is bent to extend toward the outer side of the elastic unit 50, whereby the opening 59 is open along the Z-direction reference axis (or in the plug-in direction of the conductive wire 80). Accordingly, the elastic unit 50 encloses or overlaps a part of the restriction body 20 or the entire restriction body 20 as shown in FIGS. 14 and 15.

Please refer to FIGS. 14 and 15. After the conductive wire 80 is plugged through the wire plug-in hole 92 into the chamber 91 of the case and the conductive component, the rear end 81 of the conductive wire 80 is securely held by the bent section 28 of the second arm of the restriction body in cooperation with the first arm 21 and the elastic unit 50. Therefore, the rear end 81 of the conductive wire is detained in the mouth section 26 of the restriction body, whereby the conductive wire will at least keep in contact with the first section 11 of the main body and the restriction body 20 (or the first arm 21.

Figure 16:
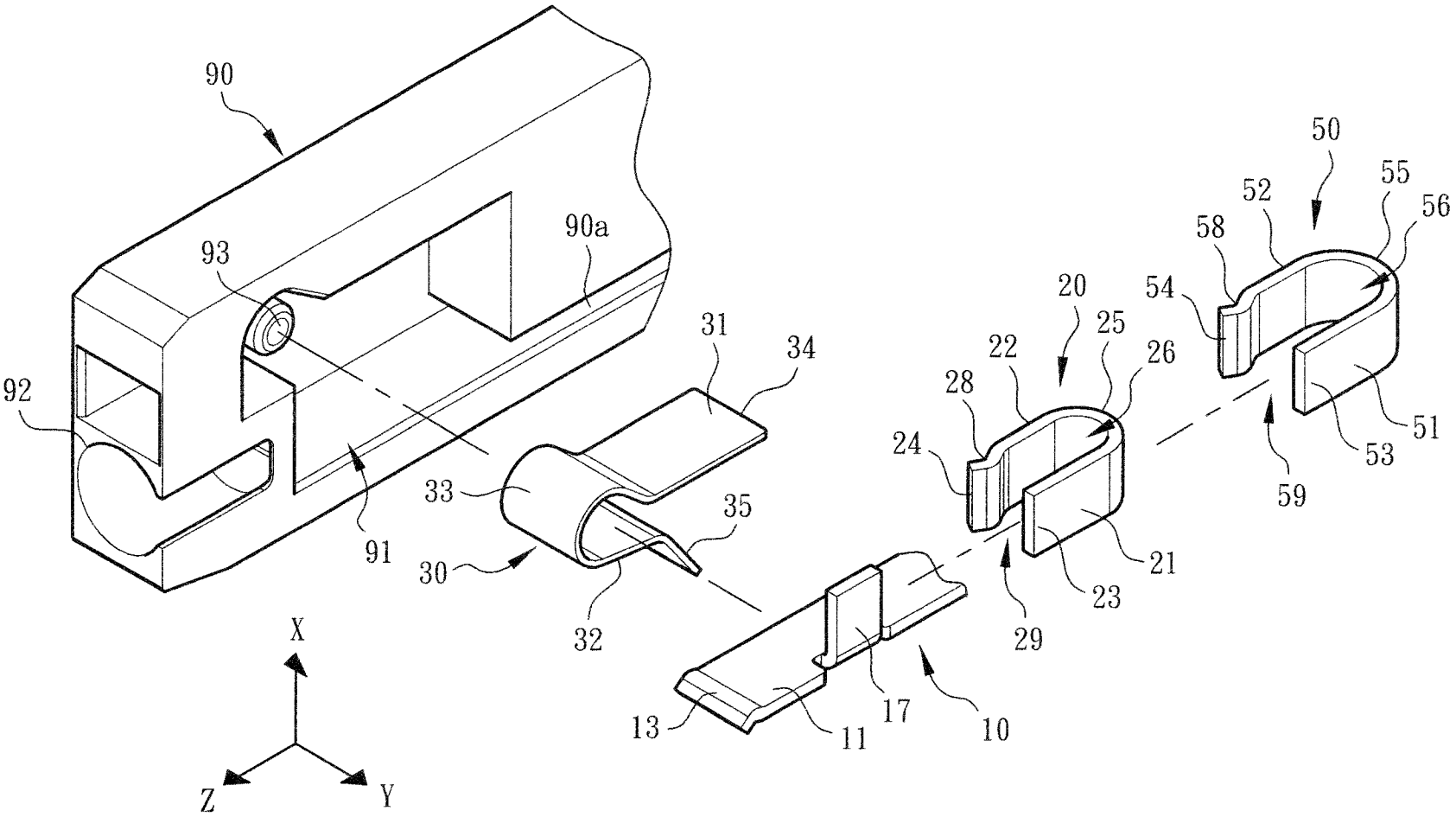
FIG. 16 is a perspective exploded view of a modified embodiment of the present invention, in which the restriction body and the main body are two pieces of components.
Figure 18:
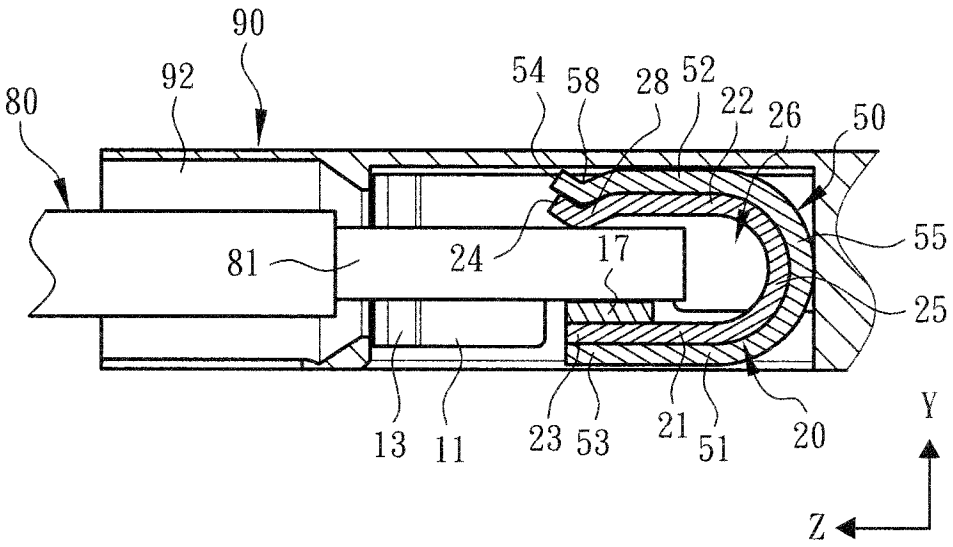
FIG. 18 is a sectional view according to FIG. 17, showing the structural relationship between the main body, the restriction body, the elastic unit and the conductive wire.
Figure 17:
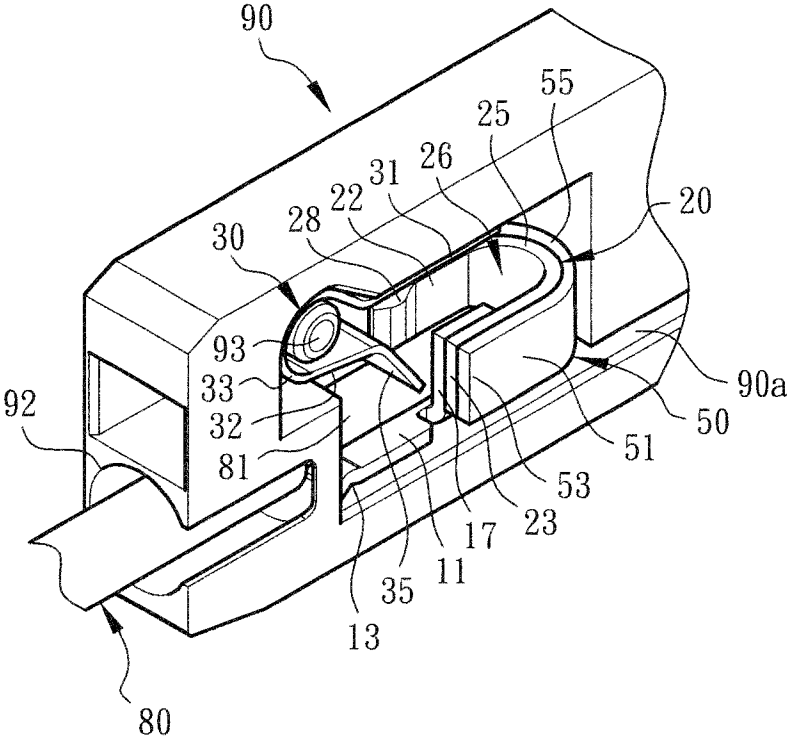
FIG. 17 is a perspective assembled view according to FIG. 16.

Please refer to FIGS. 16, 17 and 18. The restriction body 20 and the main body 10 are two pieces of components. The main body 10 (the first section 11) is bent along the X-direction reference axis to form a connection section 17. The connection section 17 is assembled and connected with the restriction body 20 (the first arm 21 and/or the second arm 22) by means of adhesion, riveting, welding, locking, etc.

Please refer to FIGS. 17 and 18. After the conductive wire 80 is plugged through the wire plug-in hole 92 into the chamber 91 of the case and the conductive component, the rear end 81 of the conductive wire 80 is securely held by the bent section 28 of the second arm of the restriction body in cooperation with the first arm 21 and the elastic unit 50. Therefore, the rear end 81 of the conductive wire is detained in the mouth section 26 of the restriction body, whereby the conductive wire will at least keep in contact with the first section 11 of the main body, the restriction body 20 (or the bent section 28 of the second arm) and the connection section 17 of the main body.

Figure 20:
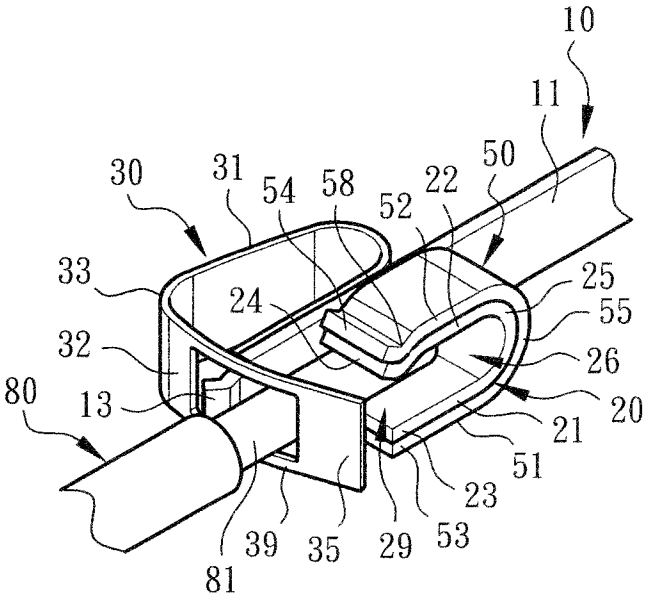
FIG. 20 is a perspective assembled view according to FIG. 19.
Figure 19:
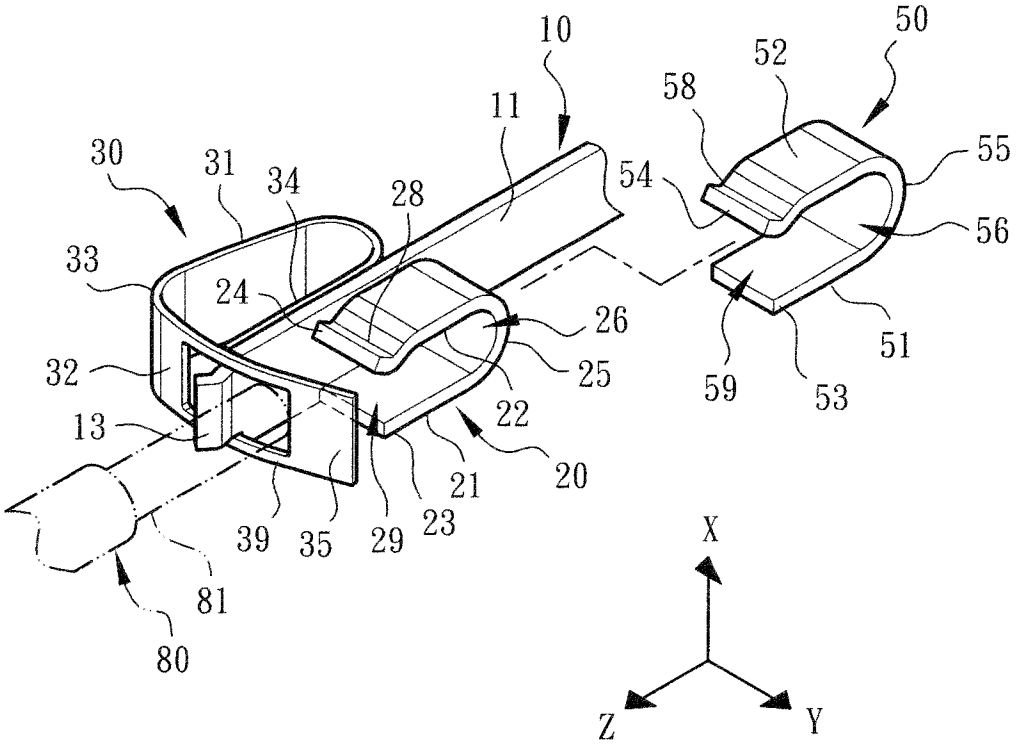
FIG. 19 is a perspective exploded view of a modified embodiment of the present invention, showing that the restriction body is integrally formed on the main body and assembled with an α-shaped metal leaf spring.

Please refer to FIGS. 19 and 20, which show a modified embodiment of the present invention. In this embodiment, the restriction body 20 is integrally formed on the main body 10 and assembled with an α-shaped metal leaf spring 30.

In this embodiment, the metal leaf spring 30 is an α-shaped structure including a first section 31, a second section 32 and a bow section 33 connected between the first and second sections 31, 32. The first section 31 has a head end 34. The second section 32 is formed with a window 39 and a tail end 35 close to or adjacent to the second section 32. The head end 34 can be pressed and connected on the main body 10 (or the first section 11). The first section 31 and the bow section 33 provide elastic effect, whereby the main body 10 (or the first section 11) can block the window 39.

When an operator presses the metal leaf spring 30, the window 39 is unblocked, permitting the conductive wire 80 to enter the main body 10 through the window 39 to be securely held by the restriction body 20 assembled with the elastic unit 50. After the external pressing force applied to the metal leaf spring 30 disappears, the second section 32 and/or the window 39 is restored to securely press/restrict the conductive wire 80 together with the first section 11 of the main body (and/or the ridge section 13) as shown in FIG. 20.

Figure 22:
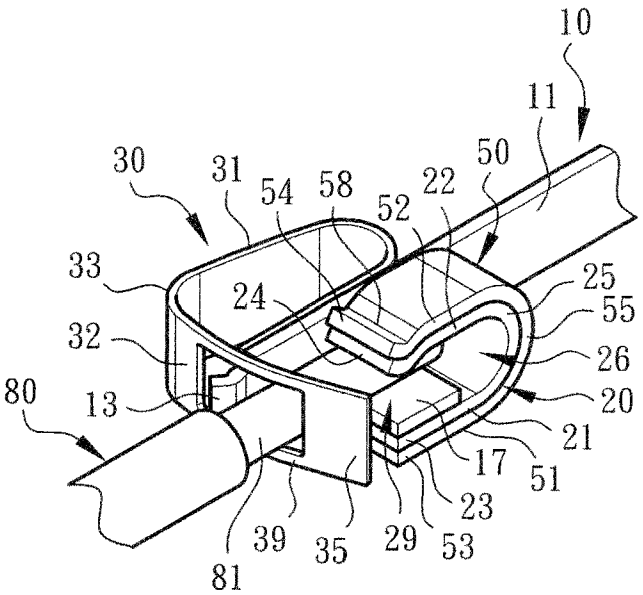
FIG. 22 is a perspective assembled view according to FIG. 21.
Figure 21:
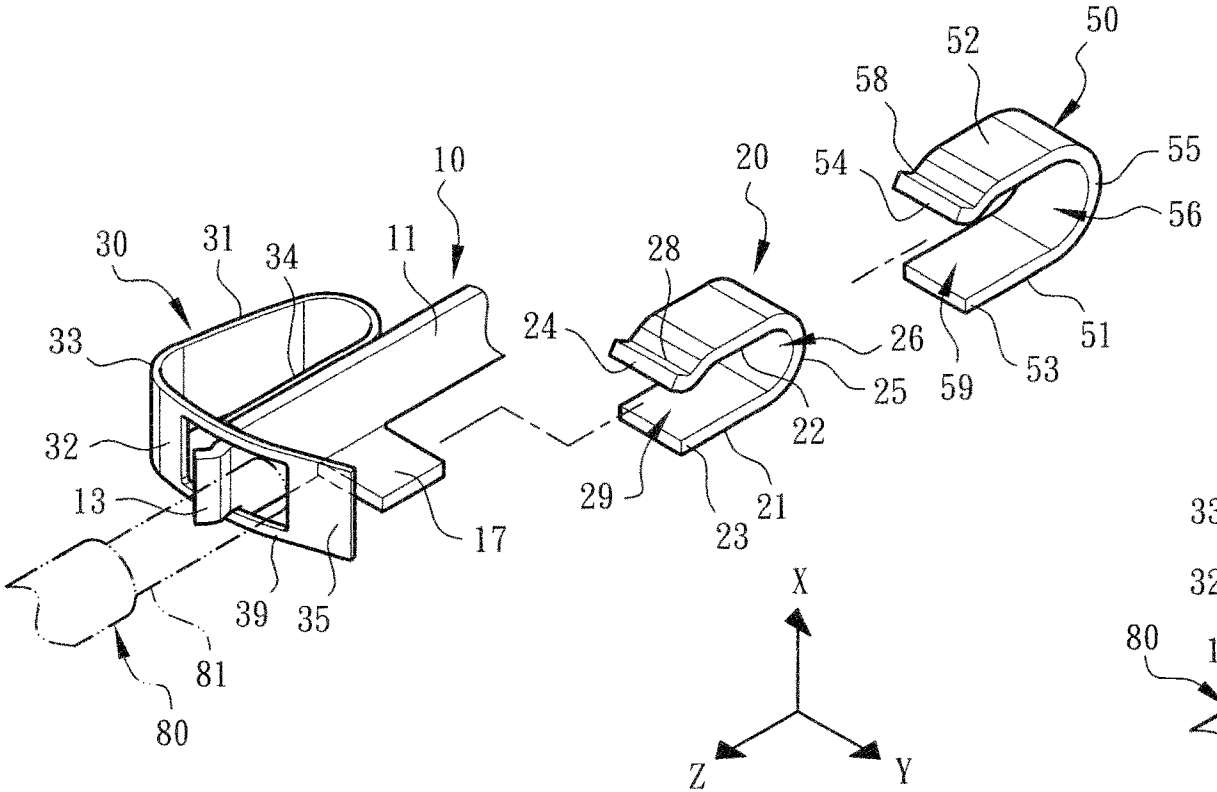
FIG. 21 is a perspective exploded view of a modified embodiment of the present invention, in which the restriction body and the main body are two pieces of components and assembled with an α-shaped metal leaf spring.

Please refer to FIGS. 21 and 22, which show a preferred embodiment of the present invention, in which the restriction body 20 and the main body 10 are two pieces of components. The restriction body 20 and the main body 10 are assembled with each other and applied to an α-shaped metal leaf spring 30.

In this embodiment, the main body 10 (or the first section 11) is bent along the X-direction reference axis to form a connection section 17. The connection section 17 is assembled and connected with the restriction body 20 (the first arm 21 and/or the second arm 22) by means of adhesion, riveting, welding, locking, etc. The restriction body 20 is assembled with the elastic unit 50 and cooperates with the window 39 of the α-shaped metal leaf spring 30 and the first section 11 of the main body (and/or the ridge section 13 of the first section 11) to together securely hold the conductive wire 80.

It should be noted that the V-shaped metal leaf spring or α-shaped metal leaf spring 30 can be alternatively assembled with and applied to the restriction body 20, the aid unit 40 or elastic unit 50 of the conductive component in accordance with practical requirement.

To speak representatively, in comparison with the conventional wire connection terminal, the conductive component structure of electrical wire connection device of the present invention has the following advantages:

1. The main body 10, the restriction body 20, the metal leaf spring 30, the aid unit 40 and the elastic unit 50 of the conductive component and the relevant components and structures have been redesigned. For example, the first section 11 or the second section 12 of the main body 10 is assembled with the restriction body 20. The restriction body 20 (and/or the elastic unit 50) has a first arm 21

(and/or 51), a second arm 22 (and/or 52), free sections 23, 24 (and/or 53, 54) and bent sections 27, 28 (and/or 57, 58). The restriction body 20 (and/or the elastic unit 50) is formed with a mouth section 26 (and/or 56) and opening 29 (and/or 59). The restriction body 20 is formed with the wing sections 21*a*, 22*a*. The restriction body 20 is assembled with the aid unit 40 or the elastic unit 50. The aid unit 40 includes a first waist section 41, a second waist section 42, a base 45 and finger sections 43, 44. The present invention is obviously different from the conventional wire connection terminal in use and operation form. Also, the present invention changes the electro-conductive structure and assembling relationship of the conventional electrical connection terminal or switch wire connection device.

2. In condition that the thickness of the conductive component and/or the metal leaf spring 30 is not increased, the cooperative structures of the conductive component or the restriction body provides a more idealistic system and greater elastic deformation amount for pressing/restricting the conductive wire 80 than the conventional electrical connection terminal. The conductive component keeps in multi-section contact with the conductive wire 80. Therefore, the conductive component is applicable to some electrical connection terminals or switch wire connection devices, permitting a large-diameter conductive wire to connect therewith. In addition, the present invention improves the shortcomings of the conventional structure that the pressing force applied to the conductive wire is insufficient and the conductive wire can be hardly securely pressed and restricted so that the conductive wire is apt to deflect or swing (due to incautious touch of an operator) to lead to poor contact and insecurity.

3. Especially, the main body 10 is assembled with the restriction body 20 and the aid unit 40 or the elastic unit 50 to provide a conductive component structure capable of helping the metal leaf spring to press and restrict the conductive wire 80. In addition, the aid unit 40 and the elastic unit 50 are replaceably assembled with the restriction body 20. The present invention obviously improves the shortcoming of the conventional structure that when the metal leaf spring presses the conductive wire, a leverage effect is often produced to cause the rear end of the conductive wire to warp up (or leave the conductive component) so that the electro-conductive contact area is reduced to affect the electro-conduction efficiency.

In conclusion, the conductive component structure of electrical wire connection device of the present invention is different from the conventional wire connection terminal in space form and is advantageous over the conventional wire connection terminal. The conductive component structure of electrical wire connection device of the present invention is effective, greatly advanced and inventive.

The above embodiments are only used to illustrate the present invention, not intended to limit the scope thereof. Many modifications of the above embodiments can be made without departing from the spirit of the present invention.

What is claimed is:

1. A conductive component structure of electrical wire connection device, the conductive component being defined with an X-direction reference axis, a Y-direction reference axis and a Z-direction reference axis, the Z-direction reference axis being parallel to a wire plug-in direction of a conductive wire, the conductive component comprising:

a main body made of an electro-conductive material in the form of a plate body, the main body at least having a first section;

a restriction body disposed on the main body, the restriction body having a base section, a first arm and a second arm connected with the base section and free sections connected with the first and second arms, the first and second arms of the restriction body being bent from the base section to extend and define a mouth section and an opening, a bent section being formed between at least one of the first and second arms and at least one of the free sections of the first and second arms; and an aid unit assembled with the restriction body for enhancing the elastic holding action force of the restriction body, the aid unit being a U-shaped structure having an arched base, a first waist section and a second waist section connected with the base and finger sections connected with the first and second waist sections, which together define a space with an opening, whereby the aid unit can provide an elastic holding effect;

wherein the conductive component in cooperation with a metal leaf spring is mounted in a chamber of a case made of insulation material, the case having a wire plug-in hole arranged along the Z-direction reference axis in communication with the chamber.

2. The conductive component structure of electrical wire connection device as claimed in claim 1, wherein the case having a locating section, the main body having a second section connected with the first section, one of the case and the second section of the main body being formed with a locating hole, the metal leaf spring being a V-shaped structure including a first section having a head end, a second section having a tail end and a bow section connected between the first and second sections.

3. The conductive component structure of electrical wire connection device as claimed in claim 2, wherein the first section of the main body is in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being bent from the base section to gradually obliquely extend toward each other along the X-direction reference axis to define a mouth section with a triangular configuration, a bent section being formed between each of the first and second arms and the free sections, whereby the free section of the first arm and the free section of the second arm are bent to extend away from each other so as to define an opening open along the X-direction reference axis, the restriction body being formed with wing sections respectively protruding from the first and second arms along the Z-direction reference axis and diverging to outer side of the restriction body, one of the case and the second section of the main body being formed with a locating hole.

4. The conductive component structure of electrical wire connection device as claimed in claim 3, wherein the first and second waist sections are respectively bent from two ends of the base to extend along the X-direction reference axis and further bent toward each other along the Y-direction reference axis to form the finger sections, whereby the finger sections contact the bent section of the first arm and the bent section of the second arm of the restriction body.

5. The conductive component structure of electrical wire connection device as claimed in claim 1, wherein the case being formed with at least one of a recessed section and an insertion cavity, the main body having a second section connected with the first section, one of the case and the second section of the main body being formed with a locating hole, the metal leaf spring being a V-shaped structure including a first section having a head end, a second section having a tail end and a bow section connected between the first and second sections.

6. The conductive component structure of electrical wire connection device as claimed in claim 5, wherein the first section of the main body is in parallel to the Z-direction reference axis, the second section of the main body being perpendicularly connected with the first section, one end of the first section being formed with a raised ridge section, the second section being formed with a neck section, the restriction body being disposed on the neck section of the second section, the restriction body being made of metal material and integrally formed on the main body or assembled with the main body, the first and second arms of the restriction body being bent from the base section to pass through the neck section of the main body and gradually obliquely extend toward each other along the Z-direction reference axis to define a mouth section, a bent section being formed between the first arm of the restriction body and the free section thereof, a bent section being formed between the second arm of the restriction body and the free section thereof, whereby the free section of the first arm and the free section of the second arm are bent to extend away from each other so as to define an opening open along the Z-direction reference axis, one of the case and the second section of the main body being formed with a locating hole.

7. The conductive component structure of electrical wire connection device as claimed in claim 5, wherein the first section of the main body is in parallel to the Z-direction reference axis, the second section of the main body being perpendicularly connected with the first section, one end of the first section being formed with a raised ridge section and a notch, the second section being formed with a neck section, the restriction body being disposed on the neck section of the second section, the restriction body being made of metal material and integrally formed on the main body or assembled with the main body, the first and second arms of the restriction body being bent from the base section to gradually obliquely extend toward each other along the Z-direction reference axis to define a mouth section with a triangular configuration, a bent section being formed between each of the first and second arms and the free sections, whereby the free section of the first arm and the free section of the second arm are bent to extend away from each other so as to define an opening open along the Z-direction reference axis.

8. The conductive component structure of electrical wire connection device as claimed in claim 7, wherein the restriction body is formed with insertion sections, with which the finger sections of the aid unit are inserted, the insertion sections being groove or dent structures positioned on at least one of the bent sections, the first and second arms and the free sections of the restriction body.

9. The conductive component structure of electrical wire connection device as claimed in claim 8, wherein an inner side of the first arm and an inner side of the second arm are formed with raised structures corresponding to the insertion sections.

10. The conductive component structure of electrical wire connection device as claimed in claim 1, wherein the other end of the case opposite to the wire plug-in hole being formed with a locating slot in communication with the chamber, the locating slot extending along the Z-direction reference axis, the metal leaf spring being an α-shaped structure including a first section having a head end, a second section having a tail end and a bow section connected between the first and second sections, the second section being formed with a window, the head end being pressed and connected on the main body.

11. The conductive component structure of electrical wire connection device as claimed in claim 10, wherein the first section of the main body is in parallel to the Z-direction reference axis, one end of the first section being formed with a raised ridge section, the restriction body being made of metal material and integrally formed on the main body or assembled with the main body, at least the first and second arms of the restriction body extending along the Z-direction reference axis and at least one of the first and second arms of the restriction body being bent along the Y-direction reference axis to form the base section connected with the first and second arms so as to together define the mouth section and the opening open along the Z-direction reference axis, a bent section being formed between at least one of the first arm and the free section thereof and the second arm and the free section thereof, whereby at least one of the free section of the first arm and the free section of the second arm is bent to extend toward the outer side of the restriction body.

12. The conductive component structure of electrical wire connection device as claimed in claim 1, wherein the first section of the main body is in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being bent from the base section to gradually obliquely extend toward each other along the X-direction reference axis to define a mouth section with a triangular configuration, a bent section being formed between each of the first and second arms and the free sections, whereby the free section of the first arm and the free section of the second arm are bent to extend away from each other so as to define an opening open along the X-direction reference axis, the restriction body being formed with wing sections respectively protruding from the first and second arms along the Z-direction reference axis and diverging to outer side of the restriction body, one of the case and the second section of the main body being formed with a locating hole.

13. The conductive component structure of electrical wire connection device as claimed in claim 12, wherein the first and second waist sections are respectively bent from two ends of the base to extend along the X-direction reference axis and further bent toward each other along the Y-direction reference axis to form the finger sections, whereby the finger sections contact the bent section of the first arm and the bent section of the second arm of the restriction body.

14. The conductive component structure of electrical wire connection device as claimed in claim 1, wherein the first section of the main body is in parallel to the Z-direction reference axis, the second section of the main body being perpendicularly connected with the first section, one end of the first section being formed with a raised ridge section, the second section being formed with a neck section, the restriction body being disposed on the neck section of the second section, the restriction body being made of metal material and integrally formed on the main body or assembled with the main body, the first and second arms of the restriction body being bent from the base section to pass through the neck section of the main body and gradually obliquely extend toward each other along the Z-direction reference axis to define a mouth section, a bent section being formed between the first arm of the restriction body and the free section thereof, a bent section being formed between the second arm of the restriction body and the free section thereof, whereby the free section of the first arm and the free section of the second arm are bent to extend away from each other so as to define an opening open along the Z-direction reference axis, one of the case and the second section of the main body being formed with a locating hole.

15. The conductive component structure of electrical wire connection device as claimed in claim 1, wherein the first section of the main body is in parallel to the Z-direction reference axis, the second section of the main body being perpendicularly connected with the first section, one end of the first section being formed with a raised ridge section and a notch, the second section being formed with a neck section, the restriction body being disposed on the neck section of the second section, the restriction body being made of metal material and integrally formed on the main body or assembled with the main body, the first and second arms of the restriction body being bent from the base section to gradually obliquely extend toward each other along the Z-direction reference axis to define a mouth section with a triangular configuration, a bent section being formed between each of the first and second arms and the free sections, whereby the free section of the first arm and the free section of the second arm are bent to extend away from each other so as to define an opening open along the Z-direction reference axis.

16. The conductive component structure of electrical wire connection device as claimed in claim 15, wherein the restriction body is formed with insertion sections, with which the finger sections of the aid unit are inserted, the insertion sections being groove or dent structures positioned on at least one of the bent sections, the first and second arms and the free sections of the restriction body.

17. The conductive component structure of electrical wire connection device as claimed in claim 16, wherein an inner side of the first arm and an inner side of the second arm are formed with raised structures corresponding to the insertion sections.

18. The conductive component structure of electrical wire connection device as claimed in claim 1, wherein the first section of the main body is in parallel to the Z-direction reference axis, one end of the first section being formed with a raised ridge section, the restriction body being made of metal material and integrally formed on the main body or assembled with the main body, at least the first and second arms of the restriction body extending along the Z-direction reference axis and at least one of the first and second arms of the restriction body being bent along the Y-direction reference axis to form the base section connected with the first and second arms so as to together define the mouth section and the opening open along the Z-direction reference axis, a bent section being formed between at least one of the first arm and the free section thereof and the second arm and the free section thereof, whereby at least one of the free section of the first arm and the free section of the second arm is bent to extend toward the outer side of the restriction body.

19. The A conductive component structure of electrical wire connection device, the conductive component being defined with an X-direction reference axis, a Y-direction reference axis and a Z-direction reference axis, the Z-direction reference axis being parallel to a wire plug-in direction of a conductive wire, the conductive component comprising:

a main body made of an electro-conductive material in the form of a plate body, the main body at least having a first section;

a restriction body disposed on the main body, the restriction body having a base section, a first arm and a second arm connected with the base section and free sections connected with the first and second arms, the first and second arms of the restriction body being bent from the base section to extend and define a mouth section and an opening, a bent section being formed between at least one of the first and second arms and at least one of the free sections of the first and second arms; and an elastic unit assembled with the restriction body for enhancing the elastic holding action force of the restriction body, the elastic unit having a base, a first arm and a second arm connected with the base and free sections connected with the first and second arms, the first and second arms of the elastic unit being parallel to each other or gradually obliquely extending toward each other to define a mouth section with an opening;

wherein the conductive component in cooperation with a metal leaf spring is mounted in a chamber of a case made of insulation material, the case having a wire plug-in hole arranged along the Z-direction reference axis in communication with the chamber.

20. The conductive component structure of electrical wire connection device as claimed in claim 19, wherein the case being formed with a locating section, the main body having a second section connected with the first section, one of the case and the second section of the main body being formed with a locating hole, the metal leaf spring being a V-shaped structure including a first section having a head end, a second section having a tail end and a bow section connected between the first and second sections.

21. The conductive component structure of electrical wire connection device as claimed in claim 20, wherein the first section of the main body is in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being bent from the base section to gradually obliquely extend toward each other along the X-direction reference axis to define a mouth section with a triangular configuration, a bent section being formed between each of the first and second arms and the free sections, whereby the free section of the first arm and the free section of the second arm are bent to extend away from each other so as to define an opening open along the X-direction reference axis, the restriction body being formed with wing sections respectively protruding from the first and second arms along the Z-direction reference axis and diverging to outer side of the restriction body, one of the case and the second section of the main body being formed with a locating hole, the first and second arms of the elastic unit gradually obliquely extending toward each other.

22. The conductive component structure of electrical wire connection device as claimed in claim 19, wherein the case being formed with at least one of a recessed section and an insertion cavity, the main body having a second section connected with the first section, one of the case and the second section of the main body being formed with a locating hole, the metal leaf spring being a V-shaped structure including a first section having a head end, a second section having a tail end and a bow section connected between the first and second sections.

23. The conductive component structure of electrical wire connection device as claimed in claim 22, wherein the first section of the main body is in parallel to the Z-direction reference axis, the second section of the main body being perpendicularly connected with the first section, one end of the first section being formed with a raised ridge section, the second section being formed with a neck section, the restriction body being disposed on the neck section of the second section, the restriction body being made of metal material and integrally formed on the main body or assembled with the main body, the first and second arms of the restriction body being bent from the base section to pass through the neck section of the main body and gradually obliquely extend toward each other along the Z-direction reference axis to define a mouth section, a bent section being formed between the first arm of the restriction body and the free section thereof, a bent section being formed between the second arm of the restriction body and the free section thereof, whereby the free section of the first arm and the free section of the second arm are bent to extend away from each other so as to define an opening open along the Z-direction reference axis, one of the case and the second section of the main body being formed with a locating hole, the first and second arms of the elastic unit being respectively bent from two ends of the base to gradually obliquely extend toward each other along the Z-direction reference axis to define a mouth section with a triangular configuration.

24. The conductive component structure of electrical wire connection device as claimed in claim 23, wherein a bent section is formed between the first arm of the elastic unit and the free section thereof and a bent section is formed between the second arm of the elastic unit and the free section thereof, whereby the free section of the first arm and the free section of the second arm of the elastic unit are bent to extend away from each other so as to define an opening open along the Z-direction reference axis, the elastic unit overlapping at least a part of the restriction body.

25. The conductive component structure of electrical wire connection device as claimed in claim 22, wherein the first section of the main body is in parallel to the Z-direction reference axis, the second section of the main body being perpendicularly connected with the first section, one end of the first section being formed with a raised ridge section and a notch, the second section being formed with a neck section, the restriction body being disposed on the neck section of the second section, the restriction body being made of metal material and integrally formed on the main body or assembled with the main body, the first and second arms of the restriction body being bent from the base section to gradually obliquely extend toward each other along the Z-direction reference axis to define a mouth section with a triangular configuration, a bent section being formed between each of the first and second arms and the free sections, whereby the free section of the first arm and the free section of the second arm are bent to extend away from each other so as to define an opening open along the Z-direction reference axis, the first and second arms of the elastic unit gradually obliquely extending toward each other.

26. The conductive component structure of electrical wire connection device as claimed in claim 19, wherein the other end of the case opposite to the wire plug-in hole being formed with a locating slot in communication with the chamber, the locating slot extending along the Z-direction reference axis, the metal leaf spring being an α-shaped structure including a first section having a head end, a second section having a tail end and a bow section connected between the first and second sections, the second section being formed with a window, the head end being pressed and connected on the main body.

27. The conductive component structure of electrical wire connection device as claimed in claim 26, wherein the first section of the main body is in parallel to the Z-direction reference axis, one end of the first section being formed with a raised ridge section, the restriction body being made of metal material and integrally formed on the main body or assembled with the main body, at least the first and second arms of the restriction body extending along the Z-direction reference axis and at least one of the first and second arms of the restriction body being bent along the Y-direction reference axis to form the base section connected with the first and second arms so as to together define the mouth section and the opening open along the Z-direction reference axis, a bent section being formed between at least one of the first arm and the free section thereof and the second arm and the free section thereof, whereby at least one of the free section of the first arm and the free section of the second arm is bent to extend toward the outer side of the restriction body, at least the first and second arms of the elastic unit extending along the Z-direction reference axis and at least one of the first and second arms of the elastic unit being bent along the Y-direction reference axis to form the base connected with the first and second arms so as to together define a mouth section and an opening open along the Z-direction reference axis.

28. The conductive component structure of electrical wire connection device as claimed in claim 27, wherein a bent section is formed between at least one of the first arm of the elastic unit and the free section thereof and the second arm of the elastic unit and the free section thereof, whereby at least one of the free section of the first arm and the free section of the second arm of the elastic unit is bent to extend toward the outer side of the elastic unit, the elastic unit overlapping at least a part of the restriction body.

29. The conductive component structure of electrical wire connection device as claimed in claim 28, wherein the first section of the main body is bent along the X-direction reference axis to form a connection section connected with the restriction body.

30. The conductive component structure of electrical wire connection device as claimed in claim 27, wherein the first section of the main body is bent along the X-direction reference axis to form a connection section connected with the restriction body.

31. The conductive component structure of electrical wire connection device as claimed in claim 19, wherein the first section of the main body is in parallel to the Z-direction reference axis, the second section of the main body being perpendicularly connected with the first section, one end of the first section being formed with a raised ridge section, the restriction body being disposed on the first section, the restriction body being made of metal material and integrally formed on the main body or assembled with the main body, the first and second arms of the restriction body being bent from the base section to gradually obliquely extend toward each other along the X-direction reference axis to define a mouth section with a triangular configuration, a bent section being formed between each of the first and second arms and the free sections, whereby the free section of the first arm and the free section of the second arm are bent to extend away from each other so as to define an opening open along the X-direction reference axis, the restriction body being formed with wing sections respectively protruding from the first and second arms along the Z-direction reference axis and diverging to outer side of the restriction body, one of the case and the second section of the main body being formed with a locating hole, the first and second arms of the elastic unit gradually obliquely extending toward each other.

32. The conductive component structure of electrical wire connection device as claimed in claim 19, wherein the first section of the main body is in parallel to the Z-direction reference axis, the second section of the main body being perpendicularly connected with the first section, one end of the first section being formed with a raised ridge section, the second section being formed with a neck section, the restriction body being disposed on the neck section of the second section, the restriction body being made of metal material and integrally formed on the main body or assembled with the main body, the first and second arms of the restriction body being bent from the base section to pass through the neck section of the main body and gradually obliquely extend toward each other along the Z-direction reference axis to define a mouth section, a bent section being formed between the first arm of the restriction body and the free section thereof, a bent section being formed between the second arm of the restriction body and the free section thereof, whereby the free section of the first arm and the free section of the second arm are bent to extend away from each other so as to define an opening open along the Z-direction reference axis, one of the case and the second section of the main body being formed with a locating hole, the first and second arms of the elastic unit being respectively bent from two ends of the base to gradually obliquely extend toward each other along the Z-direction reference axis to define a mouth section with a triangular configuration.

33. The conductive component structure of electrical wire connection device as claimed in claim 32, wherein a bent section is formed between the first arm of the elastic unit and the free section thereof and a bent section is formed between the second arm of the elastic unit and the free section thereof, whereby the free section of the first arm and the free section of the second arm of the elastic unit are bent to extend away from each other so as to define an opening open along the Z-direction reference axis, the elastic unit overlapping at least a part of the restriction body.

34. The conductive component structure of electrical wire connection device as claimed in claim 19, wherein the first section of the main body is in parallel to the Z-direction reference axis, the second section of the main body being perpendicularly connected with the first section, one end of the first section being formed with a raised ridge section and a notch, the second section being formed with a neck section, the restriction body being disposed on the neck section of the second section, the restriction body being made of metal material and integrally formed on the main body or assembled with the main body, the first and second arms of the restriction body being bent from the base section to gradually obliquely extend toward each other along the Z-direction reference axis to define a mouth section with a triangular configuration, a bent section being formed between each of the first and second arms and the free sections, whereby the free section of the first arm and the free section of the second arm are bent to extend away from each other so as to define an opening open along the Z-direction reference axis, the first and second arms of the elastic unit gradually obliquely extending toward each other.

35. The conductive component structure of electrical wire connection device as claimed in claim 19, wherein the first section of the main body is in parallel to the Z-direction reference axis, one end of the first section being formed with a raised ridge section, the restriction body being made of metal material and integrally formed on the main body or assembled with the main body, at least the first and second arms of the restriction body extending along the Z-direction reference axis and at least one of the first and second arms of the restriction body being bent along the Y-direction reference axis to form the base section connected with the first and second arms so as to together define the mouth section and the opening open along the Z-direction reference axis, a bent section being formed between at least one of the first arm and the free section thereof and the second arm and the free section thereof, whereby at least one of the free section of the first arm and the free section of the second arm is bent to extend toward the outer side of the restriction body, at least the first and second arms of the elastic unit extending along the Z-direction reference axis and at least one of the first and second arms of the elastic unit being bent along the Y-direction reference axis to form the base connected with the first and second arms so as to together define a mouth section and an opening open along the Z-direction reference axis.

36. The conductive component structure of electrical wire connection device as claimed in claim 35, wherein a bent section is formed between at least one of the first arm of the elastic unit and the free section thereof and the second arm of the elastic unit and the free section thereof, whereby at least one of the free section of the first arm and the free section of the second arm of the elastic unit is bent to extend toward the outer side of the elastic unit, the elastic unit overlapping at least a part of the restriction body.

37. The conductive component structure of electrical wire connection device as claimed in claim 36, wherein the first section of the main body is bent along the X-direction reference axis to form a connection section connected with the restriction body.

38. The conductive component structure of electrical wire connection device as claimed in claim 35, wherein the first section of the main body is bent along the X-direction reference axis to form a connection section connected with the restriction body.

* * * * *